US010350613B2

(12) United States Patent
Walti et al.

(10) Patent No.: US 10,350,613 B2
(45) Date of Patent: Jul. 16, 2019

(54) METHOD AND APPARATUS FOR MANIPULATING PARTICLES

(71) Applicant: University of Leeds, Leeds, Yorkshire (GB)

(72) Inventors: Christoph Walti, Leeds (GB); Alban Josiah Smith, Leeds (GB); Richard O'Rorke, Singapore (SG); Alexander Giles Davies, Leeds (GB); Christopher David Wood, Leeds (GB)

(73) Assignee: UNIVERSITY OF LEEDS, Leeds, Yorkshire (GB)

( * ) Notice: Subject to any disclaimer, the term of this patent is extended or adjusted under 35 U.S.C. 154(b) by 568 days.

(21) Appl. No.: 14/911,839

(22) PCT Filed: May 8, 2014

(86) PCT No.: PCT/GB2014/051409
§ 371 (c)(1),
(2) Date: Feb. 12, 2016

(87) PCT Pub. No.: WO2015/022481
PCT Pub. Date: Feb. 19, 2015

(65) Prior Publication Data

US 2016/0193613 A1 Jul. 7, 2016

(30) Foreign Application Priority Data

Aug. 14, 2013 (GB) ..... 1314533.9

(51) Int. Cl.
*B03C 5/00* (2006.01)
*B03C 5/02* (2006.01)
*B01L 3/00* (2006.01)

(52) U.S. Cl.
CPC ..... *B03C 5/005* (2013.01); *B01L 3/502761* (2013.01); *B03C 5/02* (2013.01);
(Continued)

(58) Field of Classification Search
CPC ..... B01L 2400/0436; B01L 2400/0421; B01L 2400/0424; B03C 5/00; B03C 5/022;
(Continued)

(56) References Cited

U.S. PATENT DOCUMENTS 8,425,749 B1 4/2013 Ravula et al.
2006/0283252 A1* 12/2006 Liu ..... G01N 29/022 73/649
(Continued)

FOREIGN PATENT DOCUMENTS

DE 100 55 318 A1 12/2001
JP 2009002677 A 1/2009
(Continued)

OTHER PUBLICATIONS

International Search Report and Written Opinion for PCT/GB2014/051409 filed May 8, 2014, and mailed from the International Search Authority dated Aug. 1, 2014, 13 pgs.
(Continued)

*Primary Examiner* — Gurpreet Kaur
(74) *Attorney, Agent, or Firm* — Stoel Rives LLP

(57) ABSTRACT

A method and apparatus for manipulating polarizable dielectric particles. The method includes positioning a liquid containing the particles above a surface of a piezoelectric material (2). The method also includes inducing a shear-horizontal surface acoustic wave in the piezoelectric material (2), thereby to form a time-varying non-uniform evanescent electric field extending into the liquid. The method further includes using the time-varying non-uniform evanescent electric field to apply a force to at least some of the particles (50, 52) by dielectrophoresis.

20 Claims, 12 Drawing Sheets

(52) U.S. Cl.
CPC ..... *B03C 5/022* (2013.01); *B01L 2200/0652* (2013.01); *B01L 2400/0424* (2013.01); *B01L 2400/0436* (2013.01); *B01L 2400/0439* (2013.01); *B03C 2201/26* (2013.01)

(58) Field of Classification Search
CPC ..... B03C 5/024; B03C 5/026; B03C 5/005; G01N 27/221; G01N 27/447
See application file for complete search history.

(56) References Cited

U.S. PATENT DOCUMENTS

| | | | | |
|---|---|---|---|---|
| 2009/0206171 | A1* | 8/2009 | Friend | B01F 11/02 239/4 |
| 2010/0139377 | A1 | 6/2010 | Huang et al. | |
| 2010/0193358 | A1* | 8/2010 | Hamada | C12Q 1/18 204/547 |
| 2013/0192958 | A1 | 8/2013 | Ding et al. | |
| 2014/0008307 | A1* | 1/2014 | Guldiken | B01L 3/502761 210/748.05 |
| 2014/0284221 | A1* | 9/2014 | Liu | G01N 33/48728 205/777.5 |

FOREIGN PATENT DOCUMENTS

| | | | |
|---|---|---|---|
| WO | WO 2006138662 | A1 | 12/2006 |
| WO | WO 2010/123453 | A1 | 10/2010 |
| WO | 2012135663 | A2 | 10/2012 |

OTHER PUBLICATIONS

UK Search Report for GB1314533.9 dated Feb. 17, 2014, 4 pgs.

Cole, Marina et al., "Fabrication and Testing of Smart Tongue Devices for Liquid Sensing," Proceedings of IEEE Sensors 2002. Orlando, FL, Jun. 12-14, 2002; [IEEE International Conference on Sensors], New York, NY: IEEE, U.S., vol. 1, Jun. 12, 2002 (Jun. 12, 2002), pp. 237-241, XP010605091, DOI: 10.1109/ICSENS.2002.1037090, ISBN: 978-0-7803-7454-6, figures 1, 3, sections "Abstract," "Introduction," "Operational principle" and "Experimental method".

* cited by examiner

METHOD AND APPARATUS FOR MANIPULATING PARTICLES

CROSS-REFERENCE TO RELATED APPLICATIONS

This application is a national stage application under 35 U.S.C. § 371 of International Application No. PCT/GB2014/051409, titled METHOD AND APPARATUS FOR MANIPULATING PARTICLES, filed May 8, 2014, which claims priority to Great Britain Application No. 1314533.9, filed Aug. 14, 2013, all of which are hereby incorporated by reference in their entireties.

FIELD OF THE INVENTION

This invention relates to a method and apparatus for manipulating particles.

BACKGROUND OF THE INVENTION

The manipulation of particles finds application in a wide range of fields, many of which are medical in nature. Particle manipulation, typically involving the application of a force to the particles which varies with the particle type (in accordance with their size, shape or some other characteristic), can allow particles to be sorted, separated and transported. In medical applications, particle manipulation can allow the sorting and separating of certain kinds of biological material (e.g. cells).

Dielectrophoresis (DEP) is a phenomenon that affects dielectric particles that are electrically polarizable. Dielectrophoresis occurs when these particles are subjected to a non-uniform electric field. The electric field has the effect of polarizing the particles, whereby their poles align along a direction governed by the field lines. Since the electric field is non-uniform, the poles may occupy points in the electric field in which the local field differs. In these circumstances, each pole experiences a different force from the local electric field. This leads to a non-zero net force on the particle.

The net force of the particle depends on a number of factors. Dielectric particles that are distinctly more or less polarizable than the surrounding liquid will experience stronger dielectrophoresis than dielectric particles that have similar polarizability to the liquid. The polarizability of a particle in turn may be determined by its size and shape, as well as the ability of charges contained in the particle to relocate within the particle.

Since the net force on each particle depends upon the difference in force exerted on each pole by the local field, the net force will tend to be larger in non-uniform electric fields that vary significantly in strength on a scale that is comparable to the size of the particles.

Because the dielectrophoretic force is proportional to the difference in electric field felt by the respective poles of a polarized particle, but not to the direction of the field, dielectrophoretic forces are present in static and in time varying electric fields. There are several distinct mechanisms by which a particle can become polarised, however, and these occur on different timescales.

Dipoles can be formed within the particle upon exposure to an electric field, resulting in a dipole moment aligned either parallel or anti-parallel to the applied field. The direction of the induced dipole (i.e. parallel or anti-parallel with the applied field) depends on the permittivity of the particle, relative to the surrounding liquid. At short timescales, in general, the particle is less polarisable than the surrounding liquid and hence the induced dipole will be aligned anti-parallel with the applied field and negative dielectrophoresis occurs. At longer timescales, the migration of surface charges dominates which generally leads to parallel dipole alignment and positive dielectrophoresis. This results in a frequency dependence of the direction of the dielectrophoretic force in time-varying electric fields in which, generally, positive DEP occurs at low frequencies and negative DEP occurs at high frequencies.

The Clausius-Mossotti factor describes the frequency dependence of dielectrophoresis. For a given particle, the sign of the Clausius-Mossotti factor changes at a characteristic frequency $f_{cross\text{-}over}$. Typically, a particle exhibits positive dielectrophoresis (in which the particle moves toward regions of higher electric field gradient) below $f_{cross\text{-}over}$, while negative dielectrophoresis (in which the particle moves toward regions of smaller electric field gradient) is exhibited above $f_{cross\text{-}over}$. The effect of this cross-over from positive dielectrophoresis to negative dielectrophoresis (or vice versa), and the fact that different particle types typically have different values of $f_{cross\text{-}over}$, can be used to distinguish between different kinds of particle, by appropriate selection of the frequency applied. Typical frequencies for particle manipulation by dielectrophoresis range from 10-100 kHz. It is appreciated that more complex particles such as cells may exhibit a more complex frequency dependence of the Clausius-Mossotti factor.

Since certain kinds of biological material such as blood cells, bacteria and viruses are polarizable, dielectrophoresis has been used to demonstrate manipulation of these particles (see, for example: Patel, S. et al. Microfluidic separation of live and dead yeast cells using reservoir-based dielectrophoresis, Biomicrofluidics 6 (2012); Crane, J. & Pohl, A. Journal of the Electrochemical Society 115, 584-586 (1968); Gagnon, Z. Cellular dielectrophoresis: applications to the characterisation, manipulation, separation and patterning of cells. Electrophoresis 32, 2466-2487 (2011); and Alshareef, M. et al. Separation of tumor cells dielectrophoresis-based microfluidic chip, Biomicrofluidics 7 (2013)). Electrodes are used to apply electric fields to liquids containing the particles (e.g. blood cells in plasma).

A problem associated with known DEP techniques for particle manipulation is that the electrodes used to apply the electric fields are generally incompatible with the presence of the samples which are to be manipulated (see, for example, Martinex-Duarte, R. Microfabrication technologies in dielectrophoresis applications—a review, Electrophoresis 33, 3110-3132 (2012)). For example, the particles can stick to and accumulate on the electrodes. Additionally, the liquid containing the particles can corrode the electrodes, which are typically metallic. The potentials applied across the electrodes to form the electric fields for dielectrophoresis may also lead to charge flow within the liquid, leading to shorting of the electrodes and also to Joule heating of the liquid itself.

Surface acoustic waves (SAWs) are acoustic waves that propagate close to the surface of an elastic material. For Rayleigh mode surface acoustic waves, displacement of the surface occurs in two directions. Firstly, there is a transverse displacement of the surface in a direction parallel to the surface normal. Secondly, there is a longitudinal displacement in the plane of the surface, parallel to the direction of propagation of the wave. Surface acoustic waves can be generated on the surface of a piezoelectric material using transducers placed on the surface.

Rayleigh mode surface acoustic waves can couple mechanically to liquids located on the surface. It has been shown that this effect can be used to manipulate liquids, including liquid mixing and droplet transport. Rayleigh mode surface acoustic waves can also be used to trap particles contained in the liquid (see, for example, C. D. Wood, S. D. Evans, J. E. Cunningham, R. O'Rorke, C. Walti, and A. G. Davies, "Alignment of particles in microfluidic systems using standing surface acoustic waves," Applied Physics Letters, vol. 92, p. 0441404, 2008; C. D. Wood, J. E. Cunningham, R. O'Rorke, C. Walti, E. H. Linfield, A. G. Davies, and S. E. Evans, "Formation and manipulation of two-dimensional arrays of micron-scale particles in microfluidic systems by surface acoustic waves," Applied Physics Letters, vol. 94, p. 054101, 2009; and R. D. O'Rorke, C. D. Wood, C. Wälti, S. D. Evans, A. G. Davies, and J. E. Cunningham, Acousto-microfluidics: Transporting microbubble and microparticle arrays in acoustic traps using surface acoustic waves J. Appl. Phys. 111, 094911 (2012)). The particle trapping is associated with the acoustic radiation force of the surface acoustic wave and the coupling between the Rayleigh mode surface acoustic wave and the particle is therefore mechanical. For example, it has been demonstrated that particles in a liquid on a surface in which a Rayleigh mode standing wave is present will accumulate toward the nodes or antinodes of the wave. Typical frequencies for particle trapping using Rayleigh mode surface acoustic waves range from 10-1,000 MHz.

Surface acoustic waves in piezoelectric materials are accompanied by local electric fields associated with the compression and expansion of the material by the wave. In the case of Rayleigh wave acoustic particle trapping, the manipulation is dominated by the mechanical wave with the effect of the electric field being negligible. Nevertheless, acoustic sensing techniques using SAWs employ a layer of metal (e.g. gold) on the surface of the piezoelectric material to prevent any coupling between the local electric field and the liquid or the particles contained therein.

SUMMARY OF THE INVENTION

Aspects of the invention are set out in the accompanying independent and dependent claims. Combinations of features from the dependent claims may be combined with features of the independent claims as appropriate and not merely as explicitly set out in the claims.

According to an aspect of the invention, there is provided a method of manipulating polarizable dielectric particles. The method includes positioning a liquid containing the particles above a surface of a piezoelectric material. The method also includes inducing a shear-horizontal surface acoustic wave in the piezoelectric material, thereby to form a time-varying non-uniform evanescent electric field extending into the liquid. The method further includes using the time-varying non-uniform evanescent electric field to apply a force to at least some of the particles by dielectrophoresis.

According to another aspect of the invention, there is provided an apparatus for manipulating polarizable dielectric particles contained in a liquid. The apparatus includes a substrate comprising a piezoelectric material. The apparatus also includes a liquid-receiving region located above a surface of the substrate. The apparatus further includes a first transducer configured to induce a shear-horizontal surface acoustic wave in the piezoelectric material beneath the liquid-receiving region, thereby to form a time-varying non-uniform evanescent electric field extending into the liquid-receiving region for applying a force to at least some of the particles by dielectrophoresis.

Accordingly, a new approach to particle manipulation is provided in which a shear-horizontal surface acoustic wave is induced in a piezoelectric material.

Shear-horizontal surface acoustic waves are surface acoustic waves for which displacement of the surface is in two directions. Firstly, there is a longitudinal displacement in the plane of the surface, parallel to the direction of propagation. Secondly, there is a transverse displacement of the surface that occurs within the plane of the surface. This transverse displacement is generally orthogonal to the direction of propagation.

Excitation of acoustic waves, such as some Love waves and surface skimming bulk waves, are examples of means by which shear-horizontal acoustic waves at a surface may be formed to produce a time-varying non-uniform evanescent electric field extending into the liquid in accordance with embodiments of this invention. For example, shear horizontal Love waves may be induced in a wave guide layer on a substrate for forming the time-varying field.

Mechanical coupling of shear-horizontal surface acoustic waves to a liquid above the surface is typically very weak because the mechanical displacement of the piezoelectric material is confined within the plane of the surface. In accordance with embodiments of this invention, it has been realised that coupling to particles in the liquid can take place indirectly, via a time-varying non-uniform evanescent electric field. The time-varying non-uniform evanescent electric field is associated with the local displacement of the piezoelectric material due to the shear horizontal surface acoustic wave. The indirect interaction involves dielectrophoresis within the evanescent electric field.

Since the applied force results from an evanescent electric field located above the surface of the piezoelectric material, there is no express need to include transducers or other metallic features in the liquid-receiving region. Problems associated with corrosion, particle sticking or short circuiting of transducers and/or other metal features can therefore be avoided. Moreover, since the liquid need not come into contact with the transducers, Joule heating of the liquid can be avoided, potentially allowing higher conductivity liquids to be used than is possible with conventional dielectrophoresis techniques. This is particularly advantageous in the case of biological samples including cells, which generally consist of relatively high-conductivity liquids. The special low-conductivity liquids currently used for DEP experiments have been shown to have detrimental effects on cell growth (Yang et al. Effects of Dielectrophoresis on Growth, Viability and Immuno-reactivity of *Listeria monocytogenes* Journal of Biological Engineering 2:6 (2008).

The forces applied to the particles can be used to perform manipulations including moving, sorting and separating the particles.

Although embodiments of this invention find application in medical fields for the manipulation (e.g. sorting, separating, transporting) of biological material (such as blood cells, stem cells, cancerous cells, bacteria, viruses, microbubbles, vesicles, liposomes, protein complexes), it is noted that in principal, embodiments of this invention can be used to manipulate other kinds of polarizable particles. Non-biological particles including, but not limited to, macromolecules, quantum dots and carbon nanotubes, may also be similarly manipulated (e.g. sorted and separated). Separation of latex beads using an apparatus according to an embodiment of this invention has, for example, been demonstrated.

In some examples, the shear-horizontal surface acoustic wave is a composite wave comprising two components travelling in opposite directions in the piezoelectric material.

In such examples, the composite waves can be produced using a pair of transducers. In other examples, a reflector may be used in conjunction with a single transducer. The reflector can be positioned so that the shear-horizontal surface acoustic wave produced by the transducer is reflected back toward the transducer, whereby the initial wave and reflected wave interfere to form a standing wave. The reflector may include a periodic structure, which may be similar to the structure of the transducer.

The composite wave may be a standing wave including one or more nodes. Nodes in the evanescent electric field coincide spatially with nodes in the shear-horizontal surface acoustic wave in the piezoelectric material, since the magnitude of the electric field is proportional to the mechanical displacement of the piezoelectric material. Under dielectrophoresis, particles will tend to move either toward or away from the nodes of the standing wave, as described in further detail below. This can allow particles in the fluid to be arranged in groups. It can also allow a time-of-flight analysis of the particles based on the degree of deflection they exhibit when exposed to the non-uniform evanescent electric field for a predetermined period of time.

In some examples, where the shear-horizontal surface acoustic wave is a composite wave, the frequency and/or phase of the components of the wave can be altered. This can allow the positions of the nodes and antinodes of the standing wave to be selectively varied. Manipulation of the particles can involve relocating the standing wave in this manner, whereby a force is applied to the particles to urge them toward a new equilibrium position in accordance with the new position of the standing wave. Thus, the particles can be selectively relocated within the liquid-receiving region. In some embodiments, this can allow the apparatus to operate as a valve.

In some embodiments, the liquid may contain more than one type of particle.

Typically, each type of particle has its own polarization properties. These differing properties can lead to different behaviour under dielectrophoresis. For example, some particles exhibit positive dielectrophoresis (in which the particles move toward regions of higher electric field gradient), while others exhibit negative dielectrophoresis (in which the particles move toward regions of lower electric field gradient). Whether the particle exhibits positive or negative dielectrophoresis depends on the Clausius-Mossotti factor for that particle.

The Clausius-Mossotti factor is itself frequency dependent, so that particles generally cross-over from exhibiting positive dielectrophoresis to negative dielectrophoresis at a characteristic frequency referred to herein as $f_{cross\text{-}over}$. This frequency dependence can itself be used to sort and separate particles by appropriate selection and/or adjustment of the applied frequency.

In some embodiments, the liquid receiving region may be formed from a fluid channel located above the surface of the substrate. The channel of the liquid receiving region may be furcated at one end, to form branches. In some embodiments, particles manipulated by dielectrophoresis can be directed along the different branches as they exit the liquid receiving region. For example, particles of a first type which are separated from particles of a second type in the manner described above can subsequently be directed along respective branches which are positioned to receive them. The branches may be positioned, for example, at an edge of a liquid receiving region located above a surface of a substrate comprising a piezoelectric material.

In some embodiments, the method can include causing the liquid containing the particles to flow in a first direction above the surface of the piezoelectric material, and sorting particles contained in the liquid by applying a dielectrophoretic force to the particles in second direction different to the first direction. The first and second directions may be orthogonal. The flow of particles in the first direction may be associated with flow of the liquid in which the particles are contained.

In some examples, a time-of-flight sorting and separating technique may be used. This can involve allowing the particles to traverse the liquid-receiving region (for example by flowing the liquid in which they are contained across the liquid-receiving region), and then sorting the particles according to the amount by which they are deflected while they are under the influence of the time-varying non-uniform evanescent electric field.

The manipulation of particles according to embodiments of this invention can involve either positive or negative dielectrophoresis, or a combination of the two. For example, the deflection of particles for sorting (e.g. time-of-flight sorting) can be achieved either by positive dielectrophoresis (e.g. deflection in a first direction) or by negative dielectrophoresis (in a second, opposite direction).

In some embodiments, the frequency of the shear-horizontal surface acoustic wave induced in the piezoelectric material can have a frequency in the range 1 MHz≤f≤100 MHz. In a preferred embodiment, the frequency of the shear-horizontal surface acoustic wave induced in the piezoelectric material can have a frequency in the range 1 MHz≤f≤20 MHz. In another embodiment, the frequency of the shear-horizontal surface acoustic wave induced in the piezoelectric material can have a frequency in the range 10 MHz≤f≤50 MHz. In another embodiment, the frequency of the shear-horizontal surface acoustic wave induced in the piezoelectric material can have a frequency in the range 10 MHz≤f≤20 MHz. The physical dimensions of the transducers and the features thereof (e.g. number of interdigitated fingers present in the transducer, the dimensions of the fingers and the spacing between the fingers) can be chosen to enable the generation of these frequencies. In practical terms, it is envisaged that it would be difficult to use shear-horizontal surface acoustic waves at a frequency below 1 MHz, since the large size and cost of the transducers required to produce these frequencies could be prohibitive. On the other hand, frequencies in excess of 100 MHz would imply a liquid-receiving region (such as the channels described herein) would need to have a prohibitively small dimension (typically much less than 100 μm). Implementing a flow of liquid through channels of this size would be difficult.

For specific applications, it is envisaged that certain frequencies falling within the above mentioned frequency range would be particularly appropriate. For example, the separation of living and dead yeast cells is conventionally performed at around 10-100 kHz, where both types of cell experience different degrees of negative dielectrophoresis. According to the theory however, the difference in polarizability between these two cells is greatest around 1-20 MHz and in this range, living yeast cells experience positive DEP and dead yeast cells experience negative DEP, allowing more efficient separation than at 100 kHz. Thus, according to an embodiment of this invention, highly effective separation of yeast cells is enabled at a frequency in the range 1 MHz≤f≤20 MHz.

Embodiments of this invention can be used to manipulate various kinds of particle. Sorting of the particles can occur according to at least one of their size, shape, composition or kind. The particles may comprise biological material. Thus the particles can include mammalian cells, for example, fibroblast cells such as mouse fibroblast L929 cells. The particles can also include yeast cells (e.g. live or dead yeast cells), human breast cells (e.g. breast cancer cell MCF7 and mammary luminary epithelial cells). The biological material can include blood cells, stem cells, cancerous cells, bacteria or virions. Accordingly, embodiments of this invention may be used to perform actions such as separating stem cells from samples including other biological materials, or filtering red and white blood cells from blood plasma, or separating cancerous cells from samples including healthy cells.

In some embodiments, the polarisabilty of the liquid can be altered by changing its conductivity. The conductivity of the liquid can be selected according to the Clausius-Mossotti factor of the particles to be manipulated. This can allow a force to be applied to at least some of the particles either by positive or negative dielectrophoresis in the time-varying non-uniform evanescent electric field. The conductivity may be selected such that different particles in the field experience different kinds of dielectrophoresis (e.g. positive or negative) to aid separation of the particles.

In one embodiment, the conductivity of the liquid can be in the range 0.001 to 2.0 S/m. In another embodiment, the conductivity of the liquid can be in the range 0.1 to 1.0 S/m.

In some examples, one or more reflectors can be provided to reflect energy produced by the transducer(s) of the apparatus back toward the liquid-receiving region.

In some embodiments, one or more sensors can be positioned to sense a property of particles in the fluid. These sensors can be located to coincide with predetermined positions at which particles are to be aligned by dielectrophoresis. These positions may, for example, correspond to nodes or anti-nodes in the evanescent electric field.

The substrate can, for example, comprise a monolithic portion of piezoelectric material. Alternatively, the substrate can include a bulk region onto which a piezoelectric material is grown or deposited. Seed and/or buffer layers may be located in between the bulk region and the piezoelectric layer. The piezoelectric material can, for example, include lithium tantalate, quartz, langasite, or lithium niobate. As described in more detail below, the orientation of the crystal axes of the piezoelectric material can be chosen in accordance with the desired properties of the shear-horizontal surface acoustic wave and the evanescent electric field. For example, the piezoelectric material can comprise 42° Y rotated lithium tantalate.

According to a further aspect of the invention, there is provided a microfluidic chip comprising the apparatus for manipulating polarizable dielectric particles contained in a liquid as described above.

According to another aspect of the invention, there is provided a microfluidic system comprising the microfluidic chip described above.

BRIEF DESCRIPTION OF THE DRAWINGS

Embodiments of the present invention will be described hereinafter, by way of example only, with reference to the accompanying drawings in which like reference signs relate to like elements and in which.

DETAILED DESCRIPTION

Embodiments of the present invention are described in the following with reference to the accompanying drawings.

According to the embodiments of this invention, there can be provided a method and apparatus for manipulating polarizable dielectric particles. Examples of dielectric particles that are polarizable include biological material including viruses or cells such as blood cells, stem cells, cancerous cells, or bacteria. In accordance with embodiments of this invention, it has been realised that cells of this kind can be manipulated by dielectrophoresis in the time-varying non-uniform evanescent electric field that is generated close to the surface of a piezoelectric material when a shear-horizontal surface acoustic wave is induced in the piezoelectric material.

Figures 1A, 1B:
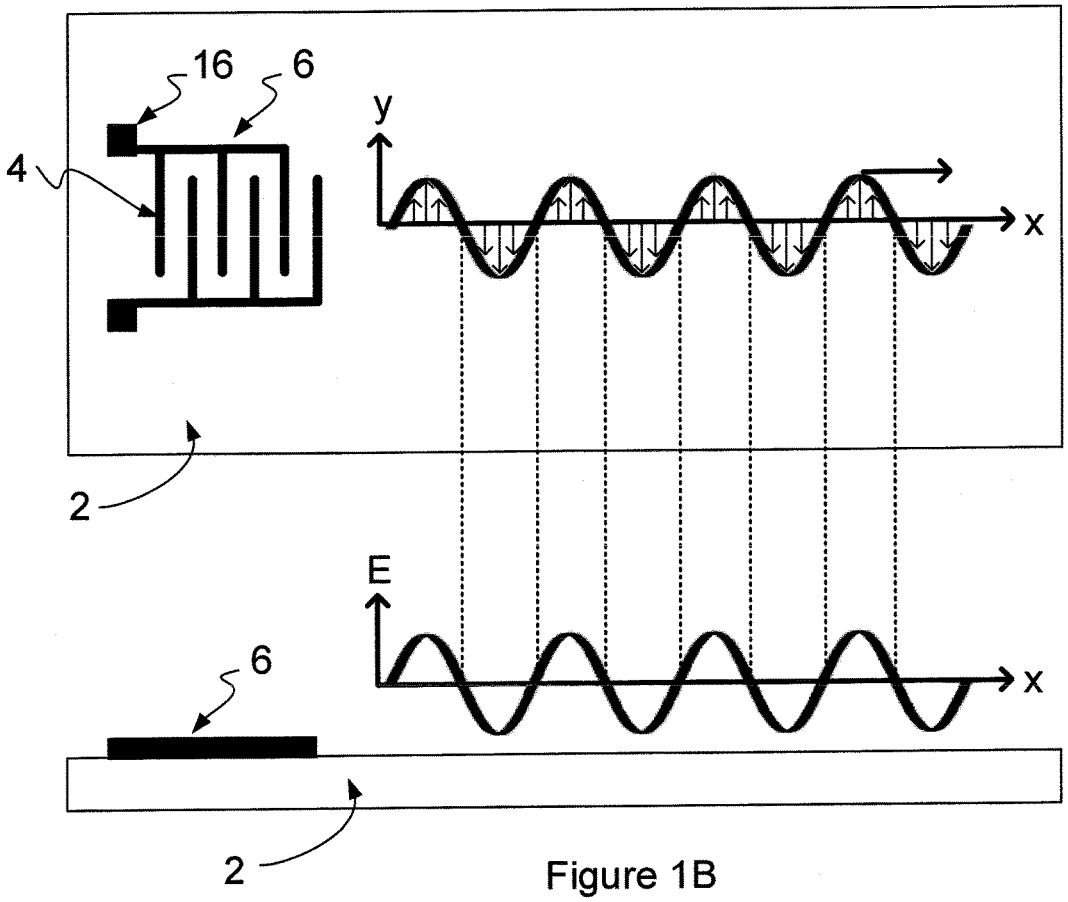
FIGS. 1A and 1B schematically illustrate the creation of a time-varying non-uniform evanescent electric field by inducing a shear-horizontal surface acoustic wave in a piezoelectric material in accordance with an embodiment of the invention.

An example of the generation of a time-varying non-uniform evanescent electric field is schematically illustrated in FIGS. 1A and 1B. FIG. 1A shows the major surface of a substrate 2 viewed from above. The substrate 2 comprises a piezoelectric material. A transducer 6 is located on the surface. The transducer 6 is operable to apply a local electric field for inducing acoustic waves in the piezoelectric material.

In this example, the transducer 6 includes two sets of fingers 4 that are interdigitated. Each set of fingers 4 is provided with a terminal 16, such as a bond pad, to which a potential can be applied. The bond pads may vary in size and shape, and can for example extend along the entire length of the transducer 6. The size and shape of the bond pads is not critical to the operation of the apparatus described herein, but can be tailored to suit the packaging of the device.

The transducer 6 may typically comprise a metallic material (e.g., gold, aluminium, copper or an alloy) deposited on to the surface of the substrate 2, with the use of thin adhesion layers and/or capping layer(s) (e.g. titanium or chromium), where appropriate. The transducers 6 can be formed on the surface of the substrate 2 by conventional means, for example using known lithographic patterning techniques. As discussed herein, the physical size of the transducer can be tailored to the intended frequencies for the acoustic waves that are to be induced. For example, the spacing between the neighbouring fingers 4 should be comparable in size to the desired wavelength of the surface acoustic waves.

Since the substrate 2 comprises a piezoelectric material, application of a potential across the electrodes of the transducer 6 leads to a mechanical displacement close to the surface of the substrate 2. When a time-varying potential is applied across the terminals of the transducer 6, a surface acoustic wave can be produced.

The form of surface wave is determined in part by the piezoelectric material that is used, and also by the crystallographic orientation of the material.

By selecting the appropriate material and crystallographic orientation, and by applying a time-varying potential across the electrodes of the transducer 6, a propagating shear-horizontal surface acoustic wave can be produced, emanating from the location of the transducer 6. In the example of FIG. 1A, the time-varying potential applied to the transducer terminals is sinusoidal, thereby to produce a shear-horizontal surface acoustic wave having a sinusoidal profile.

Examples of materials that may be used in accordance with embodiments of this invention are summarised in the Table 1. In particular, the listed materials support the propagation of shear-horizontal surface acoustic waves of the kind described herein. The Table 1 also indicates the crystallographic orientation that may be used with each material, and the direction in which the shear-horizontal surface acoustic wave propagates. This list of materials is non-exhaustive.

TABLE 1

Piezoelectric Materials for Supporting Shear-Horizontal Surface Acoustic Waves

| Material and Orientation | Direction of SAW propagation |
|---|---|
| Lithium tantalate; 42 degree Y rotated | propagation along X axis |
| Lithium tantalate; 36 degree Y cut | propagation along X axis |
| ST-cut quartz | propagation in the direction perpendicular to the X axis |
| Langasite; 22 degree Y-rotated | propagation along X axis |
| Lithium niobate; 64 degree Y-cut | propagation along X axis |

The sinusoidal shear-horizontal surface acoustic wave produced by the transducer 6 is schematically illustrated in FIG. 1A. The longitudinal propagation wave vector of the wave is in the x-direction shown in the Figure (note that the crystallographic x-direction shown in the Figures does not necessarily correspond to the x direction mentioned in the table of materials shown above). Accordingly, the direction of the longitudinal displacement associated with the wave is located parallel to the surface of the substrate. The transverse displacement of the piezoelectric material associated with the shear-horizontal wave is also contained within the plane of the surface, parallel to the y-axis.

FIG. 1B shows a side view of the substrate 2 and the transducer 6. FIG. 1B also schematically illustrates the evanescent electric field that is generated by the presence of the shear-horizontal surface acoustic wave in the piezoelectric material of the substrate 2. The local field E at the surface of the substrate 2 is proportional to the displacement of the surface associated with the acoustic wave. Accordingly, and as can be seen in FIG. 1B, the local value of E is in phase with the displacement of the surface in the y-direction indicated in FIG. 1A. The electric field is evanescent, and decays exponentially with increasing distance from the surface. Typically, the evanescent wave is confined to a region within one acoustic wavelength from the surface.

In the example of FIGS. 1A and 1B, the surface acoustic wave propagates in the x-direction, giving rise to an in-phase time-varying electric field that also propagates in the x-direction. The speed of propagation of the waves is governed by the acoustic velocity near to the surface of the piezoelectric material.

Figure 2:
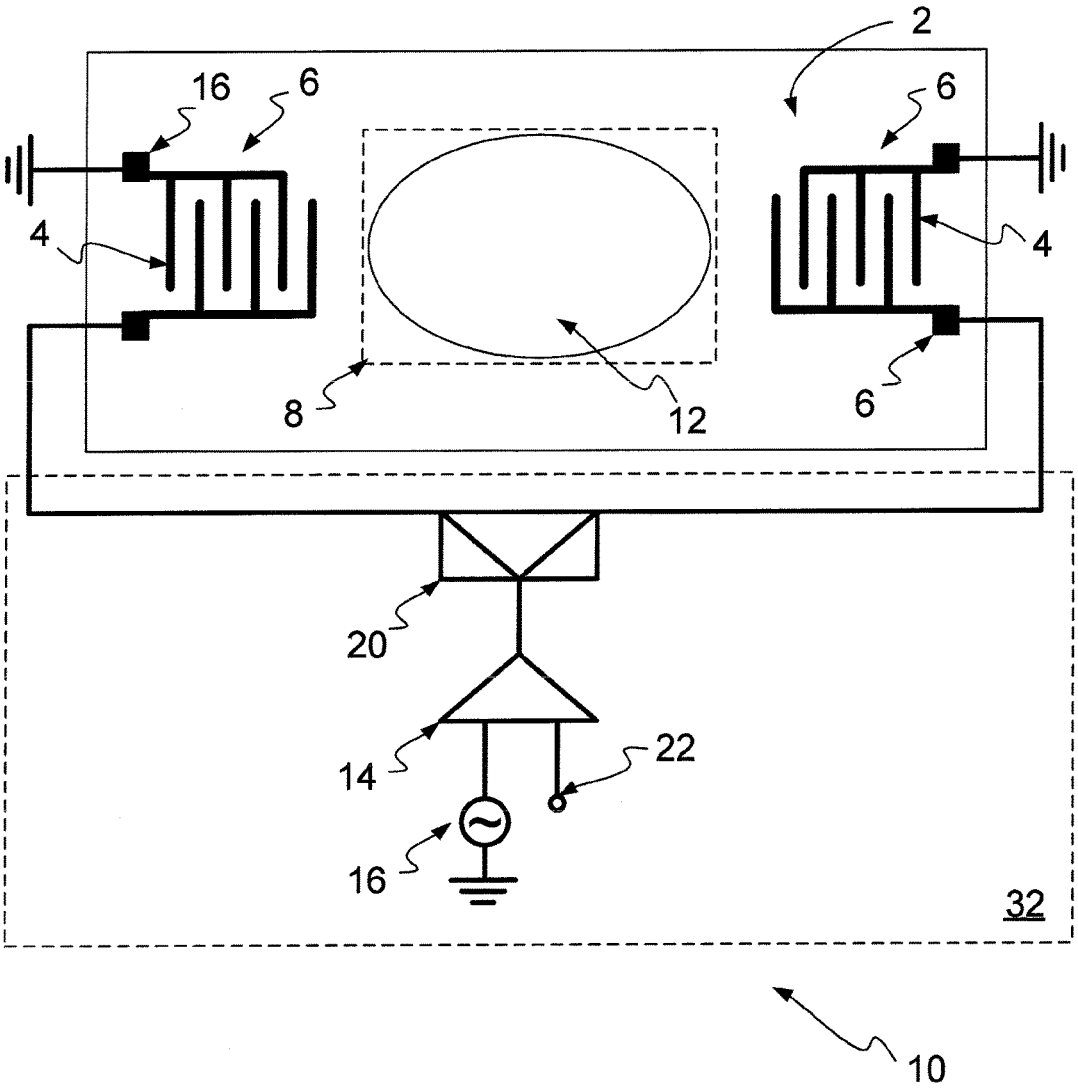
FIG. 2 shows an apparatus for manipulating polarizable dielectric particles in accordance with an embodiment of the invention.

FIG. 2 shows an example of an apparatus for manipulating polarizable dielectric particles in accordance with an embodiment of the invention.

The example of FIG. 2 incorporates features from the illustrative example of FIG. 1 for the generation of a time-varying evanescent electric field for the manipulation of polarizable dielectric particles by dielectrophoresis. The apparatus includes a substrate 2 comprising a piezoelectric material, for example a material selected from Table 1. The substrate 2 can be a bulk substrate of the selected piezoelectric material, or may alternatively comprise a bulk portion (generally non-piezoelectric) on to which a layer of piezoelectric material has been deposited. In some examples, a seed layer and/or one or more buffer layers may be located between the bulk portion and the piezoelectric layer to facilitate the deposition process. The substrate can be mounted on a printed circuit board (PCB). The substrate 2 can be provided within a package for protecting the features of the apparatus from the surrounding environment.

The substrate 2 is provided with two transducers 6. The transducers 6 are arranged on the surface of the substrate 2 in an opposed formation. In common with the example noted above in respect of FIGS. 1A and 1B, the transducers 6 can include a pair of sets of fingers 4 and bond pads 16 for connection to electronic circuitry for the application of a potential thereto.

The dimensions of the transducers can be chosen in accordance with the range of frequencies that are to be employed. In some embodiments, the width of the transducer fingers is one quarter of the shear horizontal surface acoustic wavelength, meaning that smaller transducers are used to generate higher frequency surface acoustic waves, while larger transducers are suitable for generating lower frequency surface acoustic waves. Additionally, the number of fingers provided in the transducer can be chosen in accordance with a trade-off between power and bandwidth.

A greater number of interdigitated finger pairs can allow for a more efficient coupling of the power into the device for producing acoustic waves of greater energy. However, this comes at the cost of limiting the bandwidth of frequencies that can be generated.

In this example, a first electrode of each transducer 6 is connected to a bias voltage, typically ground. The second electrode of each transducer 6 is connected to circuitry 32 for the generation and application of a time-varying potential. The circuitry 32 includes a signal generator 16 for the generation of a time-varying, for example sinusoidal, signal. The signal generator 16 is connected to an amplifier 14 along with a reference voltage 22. The output of the amplifier 14 is connected to a signal splitter 20 which divides the signal for application thereof to the remaining electrode of each transducer 6. The signal generator 16 can adjust the frequency and phase of the signal applied to each transducer, as discussed in more detail below. Optionally, means for modifying the signal produced by the signal generator 16 can be provided between the splitter 20 and one or each of the transducers 6. The means for modifying the signal can comprise a phase shifter and/or a frequency modulator, whereby the relative frequency and phase of the signals applied to the transducers 6 can be tuned.

As noted above, the transducers 6 in this example are provided on the surface of the substrate 2 in an opposed formation. In between the transducers 6, there is provided a liquid-receiving region 8. The liquid-receiving region 8 is dimensioned for receiving a liquid sample containing the particles to be manipulated.

In one example, the liquid-receiving region comprises an area on the surface of the substrate. Optionally, a second substrate, such as a glass slide or window can be placed above the liquid-receiving region to allow observation of the particles in a liquid as they are manipulated. In other examples, and as described in more detail below, the liquid-receiving region 8 can comprise a channel such as a microfluidic channel, through which the liquid containing the particles can flow.

Since the transducers 6 are located on either side of the liquid-receiving region 8, by application of a time-varying potential to the transducers 6, it is possible to generate a standing shear-horizontal surface acoustic wave in the surface of the substrate 2. The standing wave occupies the liquid-receiving region 8.

The standing wave comprises two components, namely a first component produced by a first one of the transducers 6 propagating in a first direction, and a second component produced by the other transducer 6 propagating in a second direction, where the second direction is opposite the first direction. Interference of these two components gives rise to the standing acoustic wave. The wave includes one or more nodes and antinodes. The number of nodes and antinodes present in the liquid-receiving region 8 is determined by the wavelength of the standing wave and the lateral dimensions of the liquid-receiving region 8. These parameters can be varied and selected in accordance with the manipulation techniques that are to be used for processing the particles in the liquid. Examples of these techniques will be described in more detail with relation to FIGS. 3 to 7.

The strength of the evanescent electric field associated with a shear-horizontal surface acoustic wave is generally proportional to the local magnitude of displacement at the surface of the substrate. Accordingly, the standing acoustic wave produced within the liquid-receiving region 8 generates a time-varying evanescent electric field in the liquid-receiving region having corresponding nodes and antinodes. Although the profile of the standing waves described herein is generally shown to be sinusoidal, it is envisaged that non-sinusoidal wave forms may also be used. Any wave form capable of generating a time-varying non-uniform evanescent electric field close to the surface of the substrate 2 may in principal be employed.

The presence of the time-varying evanescent electric field close to the surface of the substrate 2 can result in dielectrophoresis of particles contained in a liquid located in the liquid-receiving region. In contrast therefore to Rayleigh wave acoustic trapping techniques, manipulation of the particles in accordance with this invention can occur indirectly, via the evanescent field.

The dielectrophoretic effect on the particles depends on a number of factors. Dielectric particles that are distinctly more or less polarizable than the surrounding fluid medium will experience stronger dielectrophoresis than dielectric particles that have similar polarizability to the liquid. The polarizabilty of a particle in turn may be determined by its size and shape, as well as the ability of charges contained in the particle to relocate within the particle. The dielectrophoretic effect is further determined by the type of liquid that is used. The liquid may, for example comprise a low-conductivity liquid such as de-ionised water. In other examples, the liquid may be biological, for example blood plasma, or physiologically relevant buffer solutions including, but not limited to, phosphate buffered saline.

In some examples, a waveguide can be provided between the piezoelectric material of the substrate 2 and the liquid-receiving region 12. The waveguide can comprise a layer having a thickness of a several microns (e.g. 3-10 μm). The layer can be deposited on the surface of the substrate. The layer can comprise a material having an acoustic velocity that is lower than that in the piezoelectric material of the substrate 2. Examples of such materials include dielectric materials such as oxides (e.g. SiO2) or polymers (such as Poly(methyl methacrylate) (PMMA), or photoresist materials such as SU8 or S1813). The waveguides can be used to confine the wave energy to the surface, making it more sensitive for sensing applications. The wave guide can also increase the amplitude of the mechanical displacement associated with the shear-horizontal surface acoustic wave, which in turn can increase the amplitude of the evanescent electric field.

Figure 3:
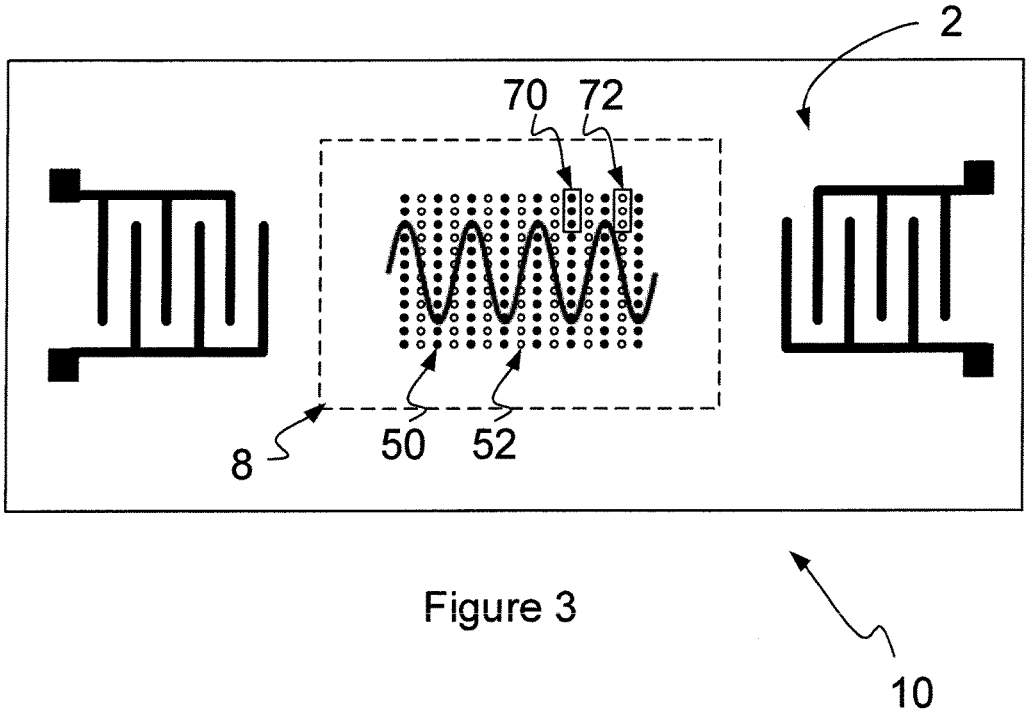
FIG. 3 shows an example of sorting a plurality of types of particle, each type of particle having respective polarization properties, in accordance with an embodiment of the invention.

A first example of particle manipulation by dielectrophoresis in accordance with an embodiment of this invention is illustrated in FIG. 3.

The wave form illustrated in FIG. 3 is that of a time-varying evanescent electric field produced by the local displacement of the piezoelectric material of the substrate 2 generated by transducers 6 via a shear-horizontal surface acoustic wave. In this example, a liquid located in the liquid-receiving region 8 comprises two kinds of particle, namely a first kind 50 and a second kind 52. Different kinds of particle generally experience dielectrophoresis with varying strengths, where the force applicable to each particle type is generally governed in part by the polarizabilty of the particle at the frequency of the time-varying electric field, in the liquid that is used.

At the frequency employed in the example of FIG. 3, the first type of particle 50 exhibits negative dielectrophoresis, in which the dielectrophoretic force on the particles 50 tends to direct them to regions of the evanescent electric field where the electric field gradient is smallest (corresponding to antinodes in the electric field). In contrast, at the frequency used in the example of FIG. 3, the second type of particles 52 experience positive dielectrophoresis, whereby the dielectrophoretic force tends to direct them toward regions of the evanescent field at which the electric field gradient is largest (corresponding to nodes in the electric field). The pattern of the time-varying evanescent electric field produced by the opposing transducers 6 on the surface of the substrate 2 via the shear-horizontal surface acoustic waves gives rise to alternating rows of particle types. Each row of particles of the first type 50 corresponds to the position of an antinode in the evanescent electric field. Each row of particles of the second type 52 corresponds to a node of the evanescent electric field.

In some embodiments, one or more sensors such as sensors 70, 72 can be positioned to sense a property of the aligned particles. As shown in FIG. 3, these sensors can be located in or close to the liquid-receiving region 8, to coincide with predetermined positions at which particles are to be aligned by dielectrophoresis. These positions may, for example, correspond to nodes or anti-nodes in the evanescent electric field. The sensors can include, for example, capacitive sensors, electrochemical sensors, acoustic sensors and/or fluorescence-based sensors.

In the present example, two transducers 6 are used. However, it is envisaged that in some examples a single transducer 6 may be used in conjunction with a reflector. The standing wave in such examples can be produced by the initial and reflected waves produced by the transducers 6 and the reflector, respectively. Accordingly, embodiments in which less than two transducers are employed are envisaged.

It is further envisaged that more than two transducers may be used. For instance, an array comprising two pairs of orthogonally aligned transducers would allow standing waves to be formed for sorting particles into groups, the groups being arranged in a two dimensional grid.

Figure 4:
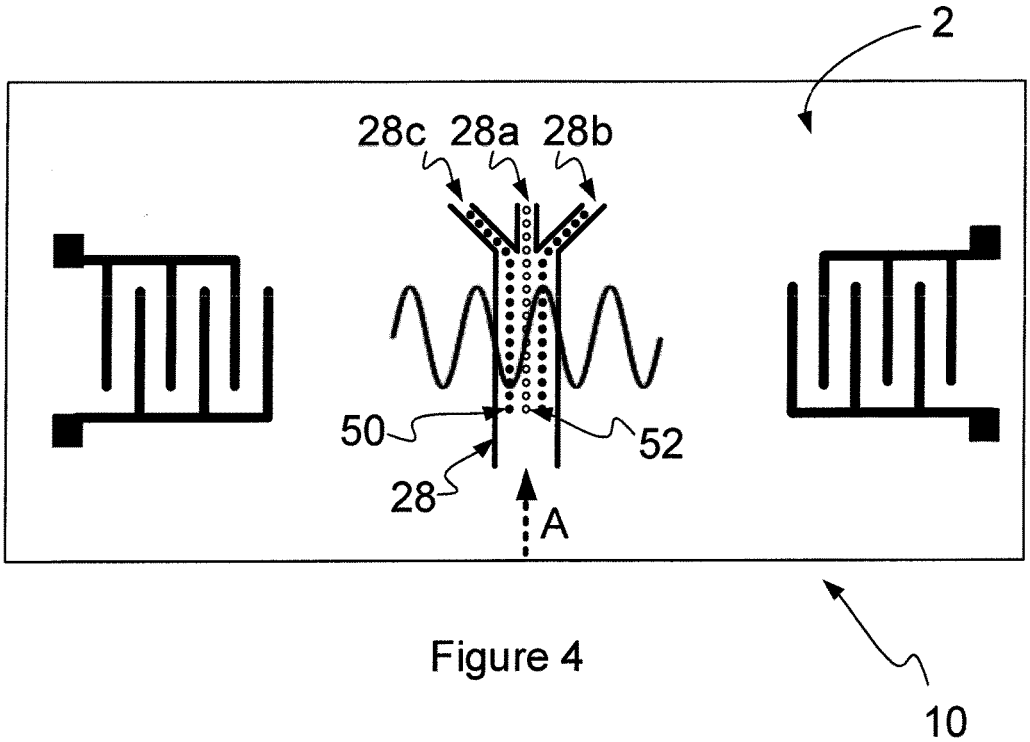
FIG. 4 shows an example of sorting and separating a plurality of types of particle, each type of particle having respective polarization properties, in accordance with an embodiment of the invention.

A second example of the manipulation of polarizable dielectric particles using a method and apparatus according to an embodiment of this invention is illustrated in FIG. 4. In this example, the liquid-receiving region 8 comprises a fluid channel 28 through which a liquid containing the particles to be manipulated can flow. The channel 28 can comprise a tube or conduit, which may itself be part of, or be connectable to, a microfluidic network in a microfluidic system.

In the present example the particles include two types, namely a first type 50 and a second type 52. The liquid flows through the channel 28 in the direction indicated by the arrow labelled 'A'. The liquid thus enters the liquid-receiving region at a first end of the channel 28, passes through the liquid-receiving region in a time determined by the rate of flow through the channel 28, and then leaves the liquid-receiving region at a second end of the channel 28. While the liquid passes through the liquid-receiving region, particles in the liquid are subjected to the evanescent electric field produced using the transducers 6.

In this example, the particles in the liquid entering the liquid-receiving region are randomly mixed together. On entering the liquid-receiving region located generally between the transducers 6, the particles contained in the liquid come under the influence of the time-varying evanescent electric field having the profile illustrated schematically in FIG. 4. This causes the randomly mixed particles to group together as follows.

At the frequency selected in the example of FIG. 4, the first type of particle 50 experiences negative dielectrophoresis and therefore tends to converge on regions in which the electric field gradient is at its smallest (antinodes in the electric field profile). The particles of the second type 52 on the other hand experience positive dielectrophoresis, in which the dielectrophoretic force urges them toward the regions in which the electric field gradient is largest (nodes in the electric field profile). This causes the particles in the liquid flowing through the channel 28 to arrange themselves into a number of alternating rows.

The number of alternating rows in the channel 28 is determined by the physical dimensions of the channel 28 as compared to the wavelength of the time-varying evanescent electric field. In the example of FIG. 4, the lateral dimension of the fluid channel 28 is approximately equal to one wavelength of the time-varying evanescent electric field. By adjustment of the phase of the standing wave, a node in the evanescent electric field is aligned with the centre of the channel 28. Accordingly, the particles of the second type 52, which experience positive dielectrophoresis tend to align with the centre of the channel 28.

On the other hand, antinodes in the evanescent electric field coincide in position to the outer regions or edges of the channel 28. This gives rise to the congregation of particles of the first type 50 toward the edges of the channel 28. To summarise, particles contained in a liquid entering the liquid-receiving region through the channel 28 are initially randomly mixed. On traversing the liquid-receiving region, these particles are subjected to dielectrophoresis, whereby they become organised into groups. These groups then exit the liquid-receiving region 8.

The channel 28 can be furcated at one end in order to receive certain particle types that have been arranged and organised using the dielectrophoretic process described above. In the example shown in FIG. 4, the channel 28 is furcated into three branches labelled 28*a*, 28*b* and 28*c*. A first branch 28*a* is positioned at the centre of the channel to receive the particles of the second type 52 that have migrated there under positive dielectrophoresis. The branches 28*b* and 28*c* are located toward the edges of the channel 28, thereby to receive particles of the first type 50 that have migrated there by negative dielectrophoresis. In this manner, particles that have been arranged into alternating rows can subsequently be separated according to particle type, as they exit the liquid-receiving region 8.

Although in the example of FIG. 4, the channel 28 is furcated into three branches, it will be appreciated that the number of branches provided at one end of the channel 28, and the position of those branches, can be selected in accordance with the number and positions of the rows of particles that will be produced by the dielectrophoretic sorting within the liquid-receiving region 8. Accordingly, in some examples only two furcated branches may be provided, while in other examples a large number may be provided. The number of branches provided can correspond to the number of nodes and antinodes of the evanescent electric field that coincide with the lateral dimension of the channel 28.

Figure 5:
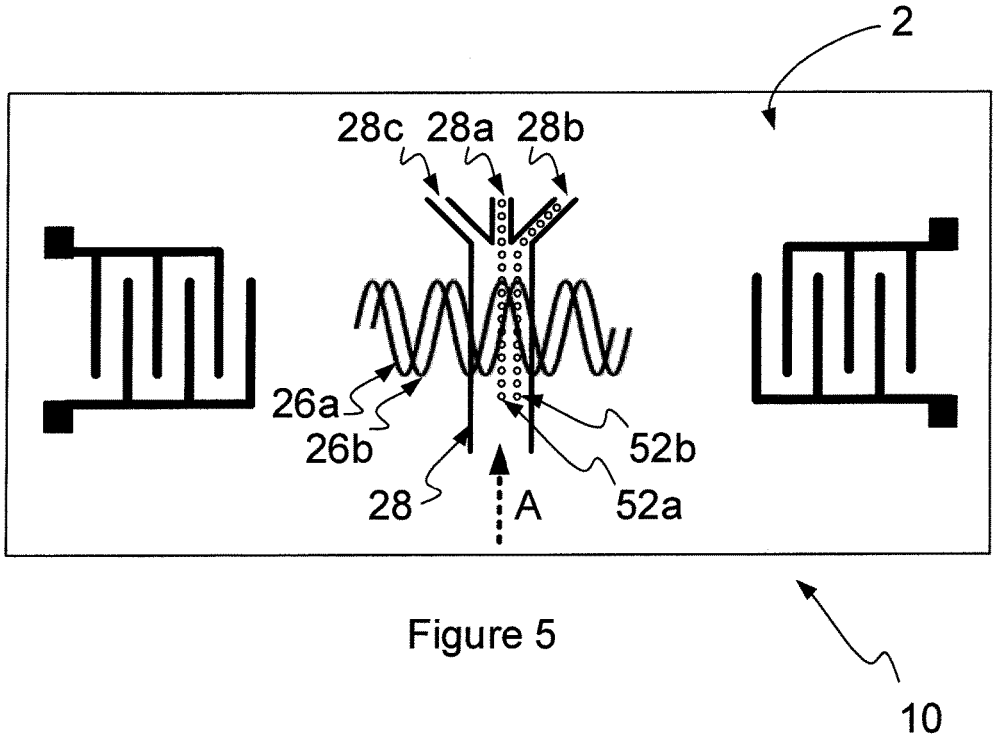
FIG. 5 shows an example of manipulating polarizable dielectric particles in accordance with an embodiment of the invention.

A next example of a method of manipulating polarizable dielectric particles in accordance with the embodiment of this invention is illustrated in FIG. 5. In this example, in common with the example of FIG. 4, the liquid containing the particles to be manipulated flows through a channel 28 in the direction indicated by the arrow labelled 'A'. The liquid contains a single type of particle 52. It will be appreciated that the methodology described here in relation to FIG. 5 may also be applied to liquids containing multiple particle types.

It can be seen from FIG. 5 that the wavelength of the time-varying electric field in this example is approximately equal to the width of the channel 28, so that a wavelength coincides with the channel 28. Initially, the phase of the time-varying electric field, formed by the induction of a standing shear-horizontal surface acoustic wave in the piezoelectric substrate 2, is selected so that it is positioned with an antinode located toward the centre of the channel 28. This corresponds to electric field profile labelled 26*a*. The particles 52 in the liquid flowing through the channel 28 in this example exhibit negative dielectrophoresis and therefore form a line of particles 52*a* toward the center of the channel 28, corresponding to the region in which the electric field gradient is smallest. In common with the example described above in relation to FIG. 4, the channel 28 may be furcated at one end into a number of branches. In FIG. 5, it is shown that a branch 28*a* is positioned to receive the aforementioned line of particles 52*a* as they exit the liquid-receiving region.

With reference again to FIG. 2, it has been explained that the signal generator 16 and/or phase shifter and/or a frequency modulator included in the circuitry 32 can modify a frequency and/or phase of the alternating potential applied to the transducers 6. This can be used to position and reposition the nodes and antinodes of the evanescent electric field relative to the liquid-receiving region 8. An example of this process is illustrated in FIG. 5 (see also the discussion of FIGS. 9B and 9C below).

Initially then, an antinode of the evanescent electric field is positioned toward the centre of the channel 28 in accordance with the evanescent electric field profile 26*a*. The antinode can be repositioned by adjustment of the phase and/or wavelength of the evanescent field, for example to move the antinode toward an edge of the channel 28 in accordance with the shifted electric field profile 26*b* in FIG. 5 (specifically, FIG. 5 illustrates repositioning using a change in phase). This causes the row of particles 52*a* to follow the repositioned antinode of the evanescent electric field, thereby to form a line of particles 52*b* in a position toward the edge of the channel 28 in accordance with the new location of the antinode.

In the present example, the channel 28 is furcated into three branches 28*a*, 28*b* and 28*c*. The above described repositioning of the line of particles can allow the particles exiting the liquid-receiving region selectively to be fed into one of the branches. As shown in FIG. 5, the repositioned row of particles 52*b* feeds into the branch 28*b*. By repositioning the antinode of the evanescent electric field laterally within the channel 28, the row of particles 52 may be fed into any one of the branches 28*a*, 28*b* or 28*c*. It will be appreciated therefore that an apparatus according to an embodiment of this invention can operate as a valve or switch for directing particles of a given type along a selected path in a microfluidic network. It is envisaged that this technique can be applied equally to particles that experience positive DEP, by adjusting the position a node of the evanescent electric field within the channel.

Figure 6:
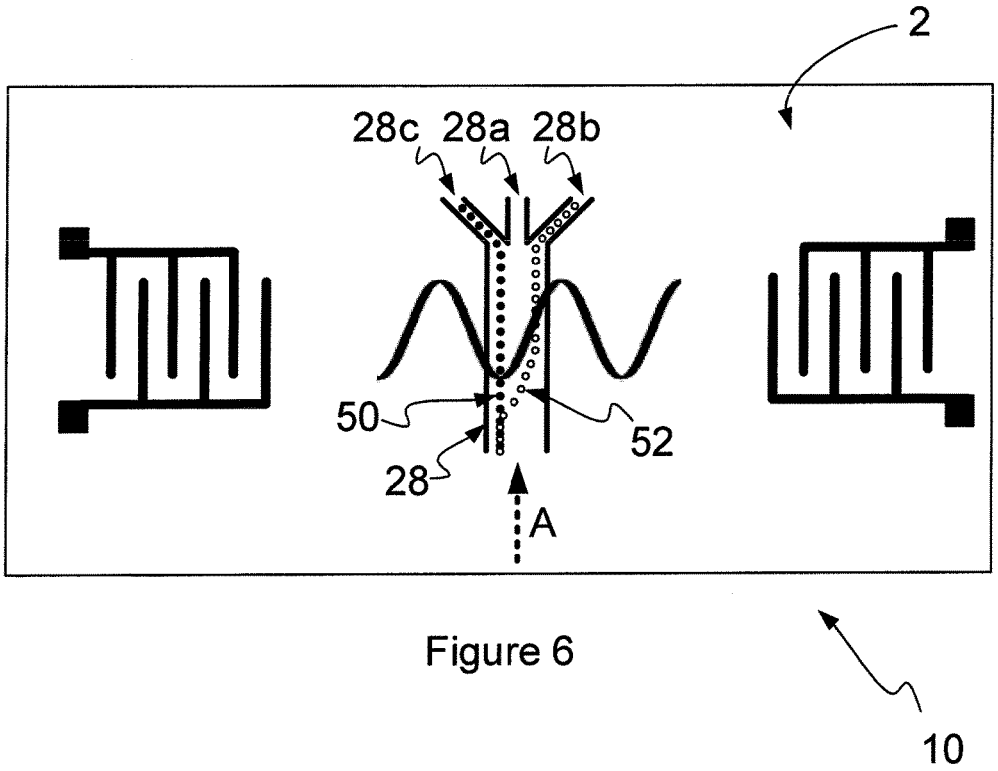
FIG. 6 shows an example of sorting and separating a plurality of types of particle, each type of particle having respective polarization properties, in accordance with an embodiment of the invention.

FIG. 6 illustrates a further example of a manipulation of polarizable dielectric particles in accordance with an embodiment of this invention. In the example of FIG. 6, the wavelength of the time-varying evanescent electric field is approximately twice the lateral dimension of the channel 28, whereby half a wavelength occupies the channel width. An antinode of the time-varying evanescent electric field is positioned toward an edge of the channel 28, whereby the opposite edge of the channel 28 corresponds approximately to a node in the electric field.

In this example, the liquid flowing through the channel 28 contains a plurality of particle types including at least a first particle type 50 that experiences negative dielectrophoresis at the frequency of the time-varying evanescent electric field and a second particle type 52 that experiences positive dielectrophoresis at the aforementioned frequency. In this example, the particles 50 and 52 enter the channel 28 toward a first side of the channel corresponding to the antinode in the time-varying evanescent electric field. This may be achieved, for example, by the provision of a narrow entrance to the channel 28 positioned toward an edge of the channel, or by conventional flow-focusing techniques.

As the particles 50 and 52 enter the channel 28, some of the particles remain at the first side of the channel 28 corresponding to the antinode in the time-varying evanescent electric field. However, the second type of particle 52 is deflected under positive dielectrophoresis and diverges away from the antinode in the time-varying evanescent electric field, toward the node in the field that is located on an opposite side of the channel 28. The amount of deflection experienced by the second kind of particle 52 is determined by the dielectrophoretic force they experience, the length of the channel 28 and the flow rate of the liquid. In the example shown in FIG. 6, the channel 28 is sufficiently long that the second kind of particle 52 is fully deflected across the width of the channel 28 during the time it takes the liquid carrying them to pass through the liquid-receiving region.

In the example of FIG. 6, the channel 28 is furcated at one end to form a number of branches 28*a*, 28*b* and 28*c*. Further or fewer branches than the three shown in FIG. 6 may be provided. The branch 28*c* is positioned to receive particles 50 that experience negative dielectrophoresis and which therefore remain toward the first side of the channel 28. The branch 28*b* in this example is positioned to receive the fully deflected particles 52 in a position corresponding to the node in the time-varying evanescent electric field.

It will be appreciated that although in FIG. 6 it has been explained that the first kind of particle 50 experiences negative dielectrophoresis, a similar result can be achieved in the case where the particles 50 experience only very weak dielectrophoresis, or indeed no dielectrophoresis at all. This may be because the particles 50 are similar in polarizability to the liquid. Alternatively, it may be that the particles 50 are in principal polarizable, but that at the frequency selected of the time-varying evanescent electric field they experience neither positive nor negative dielectrophoresis. This can occur when the frequency of the time-varying evanescent electric field corresponds to the cross-over frequency, $f_{cross\text{-}over}$, of the particles, where the frequency dependent dielectrophoresis that they experience approaches zero and switches between positive and negative dielectrophoresis. A similar result can equally be achieved using negative dielectrophoresis to deflect particles 50 across the channel, while particles 52 remain at the first side of the channel.

Figure 7:
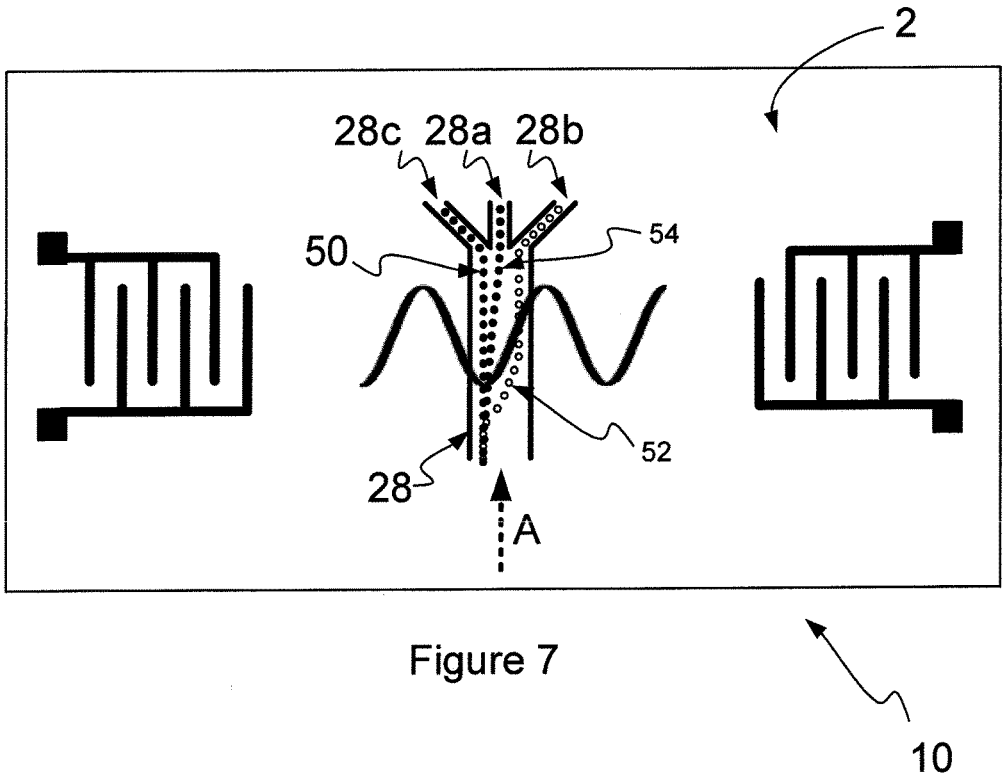
FIG. 7 shows an example of sorting and separating a plurality of types of particle using a time-of-flight approach, in accordance with an embodiment of the invention.

A similar example to that described in relation to FIG. 6 is shown in FIG. 7. In this example, a time-of-flight mode is adopted for sorting and separating the particles.

In FIG. 7, a third kind of particle 54 is included in the mixture of particles in the liquid entering the channel 28. As noted above in relation to FIG. 6, the particles 50 are not deflected within the channel 28 either because they experience negative dielectrophoresis or because they experience little or no dielectrophoresis. Again, the particles 52 are fully deflected under positive dielectrophoresis to the opposite side of the channel 28. However, the particles 54, while deflected, experience a weaker positive dielectrophoretic force than the particles 52. Over the length of the channel 28, the particles 54 are therefore deflected somewhat less than the particles 52. The amount of deflection experienced by the particles 54 is governed by the magnitude of the positive dielectrophoretic force that they experience and also by the length of the channel 28 and the flow rate. In the example of FIG. 7, the channel length is such that the particles 54 entering the channel 28 are deflected to the extent that they reach a position corresponding approximately to the middle of the channel 28 by the time they exit the channel 28. It is appreciated that the same time-of-flight sorting can be achieved using negative dielectrophoresis to deflect particles by positioning an antinode at the second side of the channel.

FIG. 7 illustrates that time-of-flight analysis can be used to sort and separate multiple particle types to be sorted within the liquid-receiving region and then separated along respective branches of a furcated channel. The branch that a given particle type takes on leaving the liquid-receiving region depends on the time spent by the particle within the liquid-receiving region (which is determined by the length of the channel and by the speed with which the liquid passes through the channel 28). It will be appreciated that time of light separation methodology can be used to separate out different kinds of particle according to their composition, size or other property that affects the magnitude of the dielectrophoretic force that they experience at the applied frequency. It is envisaged that any number of branches may be provided at one end of the channel 28 to receive a range of particles according to the amount by which they are deflected.

Figure 8:
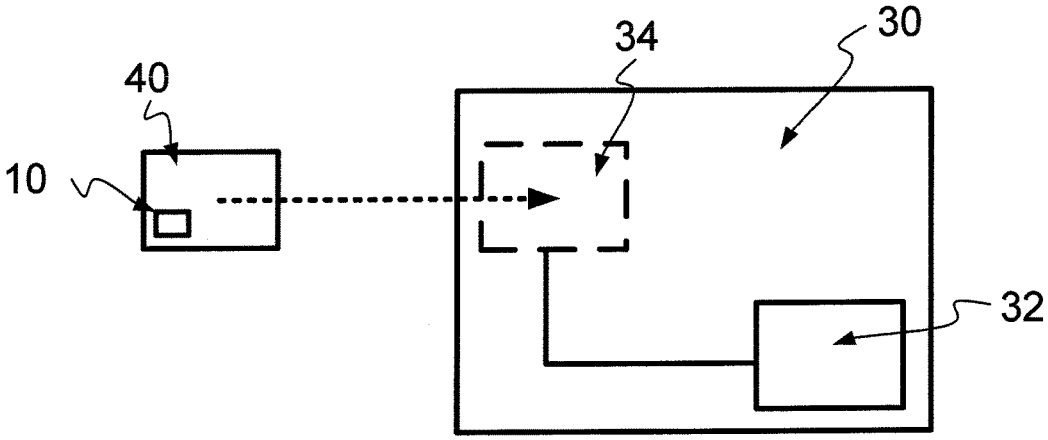
FIG. 8 shows a microfluidic system and a microfluidic chip including an apparatus for manipulating polarizable dielectric particles in accordance with an embodiment of the invention.

FIG. 8 illustrates a microfluidic system 30 according to an embodiment of the invention. The system 30 can include a network of microfluidic channels for the processing of liquids containing particles such as samples containing biological material. The system 30 can include an opening 34 for receiving a microfluidic chip 40 that incorporates an apparatus 10 for manipulating polarizable dielectric particles of the kind described herein. The microfluidic chip 40 can be installed in the microfluidic system 30 by inserting it into the opening 34. The chip 40 can include one or more ports for receiving a liquid containing particles to be manipulated. These ports can connect to the microfluidic channel network of the microfluidic system 30. The ports can thus feed the liquid containing the particles to be manipulated through the liquid-receiving region for the application of dielectrophoretic forces by the presence of the time-varying evanescent electric field.

In the example of FIG. 8, the microfluidic system 30 also includes circuitry 32 (see also FIG. 2) for generating signals to be applied to the transducers 6 of the apparatus 10 to generate the shear-horizontal surface acoustic waves in the piezoelectric substrate 2. Terminals on the microfluidic chip 40 may be provided to connect to corresponding terminals of the circuitry 32 as the microfluidic chip 40 is installed within the opening 34. In alternative examples, the circuitry 32 may instead be provided on the microfluidic chip 40 itself. In further examples, the circuitry 32 may be provided separately (i.e. neither on the chip 40 nor as part of the microfluidic system 30).

Figure 9A:
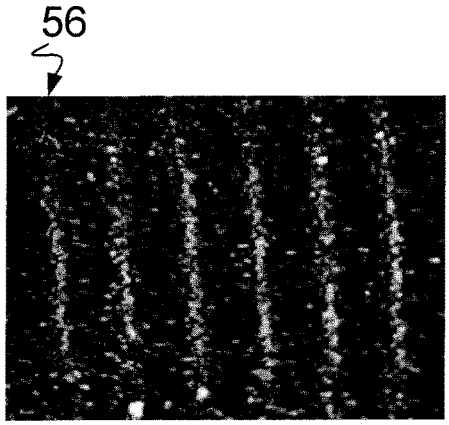
FIGS. 9A to 9C demonstrate examples of the manipulation of polarizable dielectric particles using embodiments of this invention.
Figure 9B:
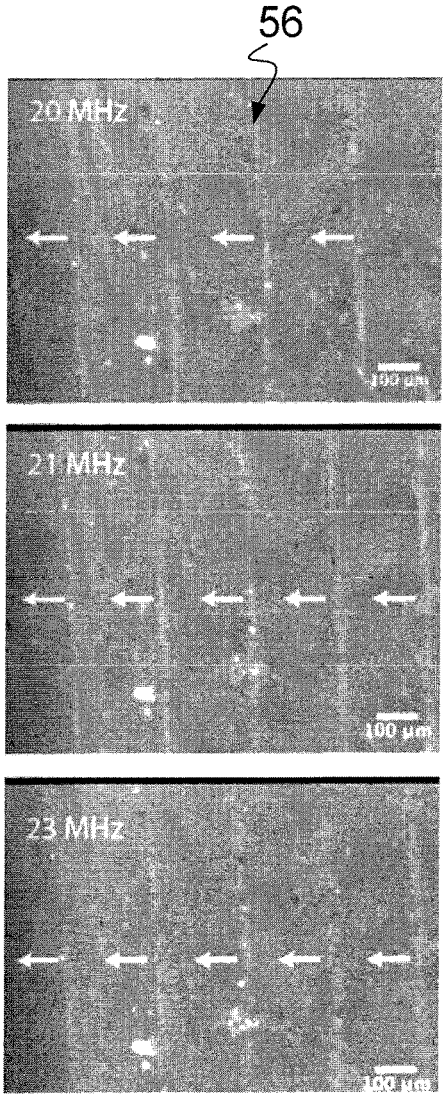
Figure 9C:
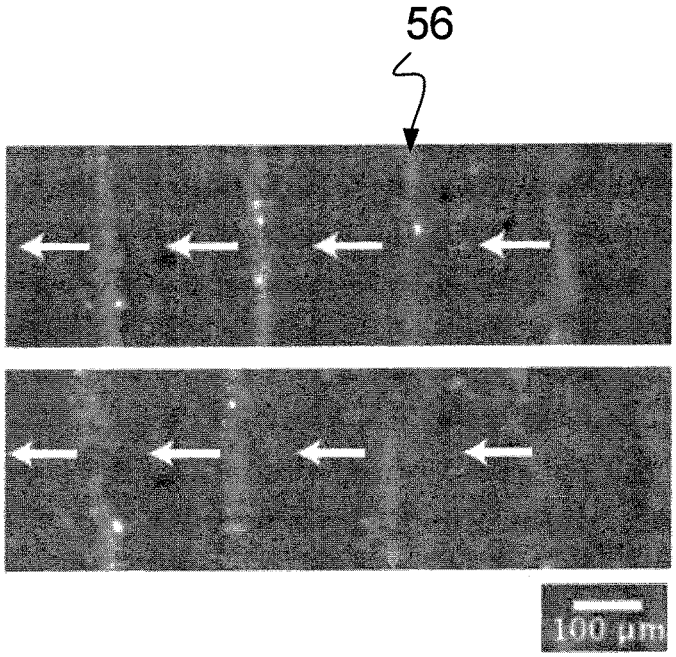

The images shown in FIGS. 9A to 9C demonstrate the manipulation of polarisable dielectric particles. Each image was produced using an apparatus of the kind described above in relation to FIG. 2. The liquid-receiving region comprised an area of the piezoelectric substrate (comprising 42 degree Y rotated lithium tantalate), onto which a 2 micro-liter droplet of de-ionised water containing the polarisable particles was positioned. The substrate measured 0.9 cm×1.2 cm. A glass cover slip was used to cover the droplet, forming a channel between the surface of the substrate and an underside of the cover slip. The channel was approximately 20-30 μm deep. The images were captured through the cover slip using a fluorescence microscope.

The particles comprised fluorescent latex beads having a diameter of approximately 1 μm. The frequency used was 21 MHz. The velocity of a shear-horizontal surface acoustic wave in the above mentioned substrate when unloaded and at room temperature is 4120 $ms^{-1}$, accordingly the acoustic wavelength was 196 μm. The transducers had a finger width of 50 μm with a mark to space ratio of 1:1. The transducers included fifteen finger pairs. The separation between the transducers was 3 mm, and the acoustic aperture was 1 mm.

Under conditions noted above, the fluorescent latex beads exhibited negative dielectrophoresis.

FIG. 9A illustrates the grouping of the latex beads into rows 56 by dielectrophoresis. These rows can be compared with the rows schematically illustrated in the example discussed above in relation to FIGS. 3 to 7. Since the beads exhibited negative dielectrophoresis, each row 56 corresponds to an antinode in the time-varying evanescent electric field. Accordingly, the spacing between each row is approximately one half of the wavelength of the field.

FIG. 9B demonstrates manipulation of the latex beads by changing the wavelength of the evanescent electric field as described above in relation to FIG. 5. By altering the wavelength of the standing wave, the nodes and antinodes can be separated out or drawn together.

The arrows in FIG. 9B illustrate the repositioning of the antinodes of the field by altering the wavelength. This was observed to cause a re-alignment of the rows 56 of latex beads, as the beads followed the repositioning of the antinodes by dielectrophoresis. The devices used in this Figure had a bandwidth of approximately 4 MHz and a centre frequency of 21 MHz. In FIG. 9B, the frequencies used were 20 MHz, 21 MHz and 23 MHz, with corresponding wavelengths of 206 μm, 196 μm, and 179 μm, respectively.

FIG. 9C demonstrates manipulation of the latex beads by changing the phase of the evanescent electric field as described above in relation to FIG. 5. The change in phase causes a shifting of the antinodes towards one or the other of the transducers (schematically illustrated by the arrows in FIG. 9C). As can be seen from the two images in FIG. 9C, it was observed that the phase shift caused a re-alignment of the rows 56 of latex beads, as the beads followed the repositioning of the antinodes of the field by dielectrophoresis.

Further examples of particle manipulation is accordance with embodiments of this invention are described below in relation to FIGS. 10 to 15.

Figure 10:
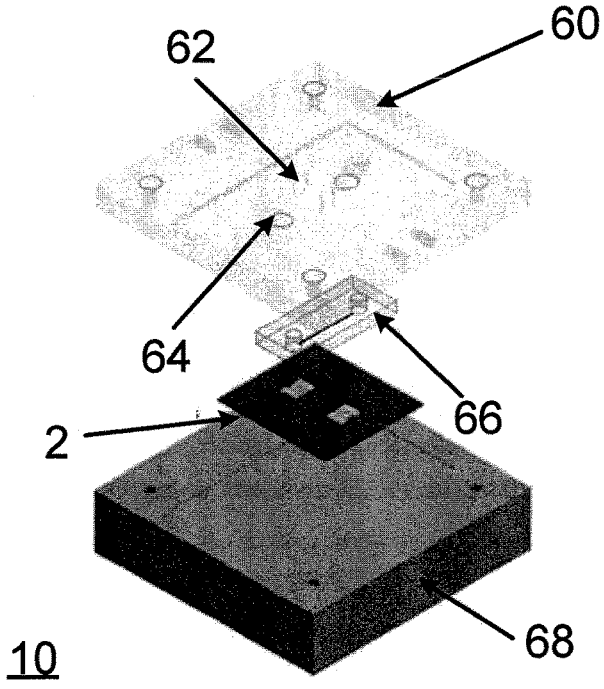
FIG. 10 shows an apparatus for manipulating polarizable dielectric particles in accordance with an embodiment of the invention.

FIG. 10 shows an apparatus 10 for manipulating polarizable dielectric particles in accordance with an embodiment of the invention. The apparatus 10 includes a base 68 which can be made from a metal such as brass. The apparatus 10 also includes a substrate 2 which comprises a piezoelectric material. In this example, the substrate 2 comprises lithium tantalate with a 42° Y-cut (see Table 1). The apparatus 10 further includes a channel portion 66. The channel portion 66 in this example comprises polydimethylsiloxane (PDMS), although any other suitable material could be used.

The apparatus 10 also includes a lid 60 which can provide protection for the underlying components of the apparatus 10. The lid 60 can also be used to apply pressure to seal the channel portion 66. The lid 60 in this example is made from an acrylic material, although other materials could also be used. The lid 60 can be provided with holes 62 to allow electrical connections to be made to transducers 6 provided on the substrate 2. These connections can, for example, take the form of gold spring contacts (small gold pins with a spring in them) located in the holes 62 and glued in place if required. The pins can be connected to wires for connection of an RF source. The bottom end of the pins can urge against the bond pads of the transducers 6 (see FIG. 11A) on the substrate 2 to complete the connection.

The lid 60 can also be provided with holes 64 that allow fluid connections to be made with the channel portion 66.

Figure 11A:
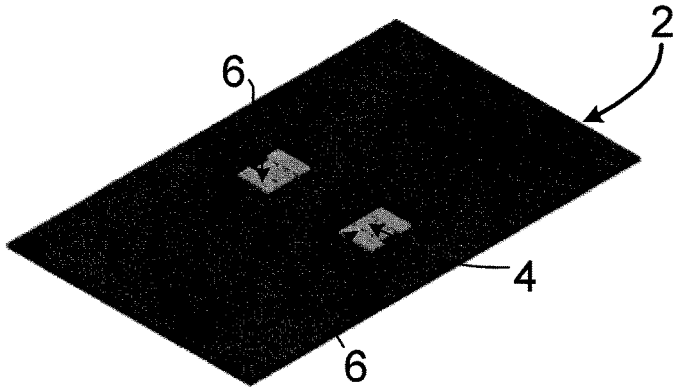
FIGS. 11A to 11C each show certain features of the apparatus of FIG. 10 in more detail.
Figure 11B:
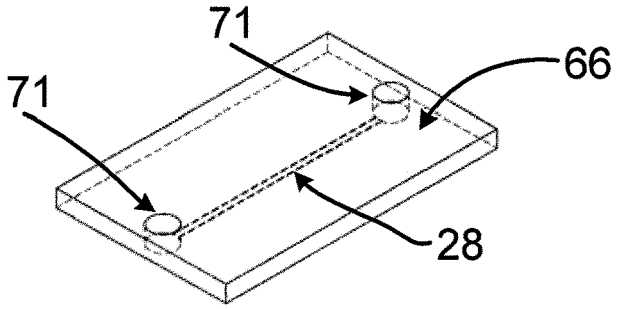
Figure 11C:
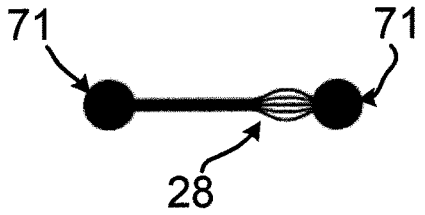

FIGS. 11A to 11C each show certain features of the apparatus of FIG. 10 in more detail.

In FIG. 11A, the substrate 2 is shown to have a pair to transducers 6 provided on a surface thereof. Each transducer 6 can include sets interdigitated fingers 4.

In FIG. 11B, the channel portion 66 is shown to include ports 71 for allowing a liquid containing particles into a channel 28. The channel 28 extends through the channel portion 66 between the ports 71. The ports 71 are aligned with the holes 64 in the lid 60 for receiving the liquid. The liquid can be injected into the apparatus 10 using, for example, a syringe. In one example, silicone tubing can fit into the holes 64 and the inflow tube can be connected to the syringe. The tubing can have an inner dimension of around 1.59 mm and an outer dimension of around 3.18 mm.

FIG. 11C shows example of the layout of the ports 71 and channel 28 in the channel portion 66. As shown in FIG. 11C, the channel 28 can split into multiple branches. Although it is shown in FIG. 11C that the branches subsequently re-converge, it is envisaged that in other examples the branches would remain apart, to facilitate separation and subsequent routing of different kinds of particles flowing through each branch. This can assist particle sorting of the kinds described above in relation to, for example, FIGS. 4 to 7.

An apparatus of the kind shown in FIGS. 10 and 11 has been used to demonstrate particle manipulation of biological cells. Details of these results are described below in relation to FIGS. 12 to 15.

Figure 12A:
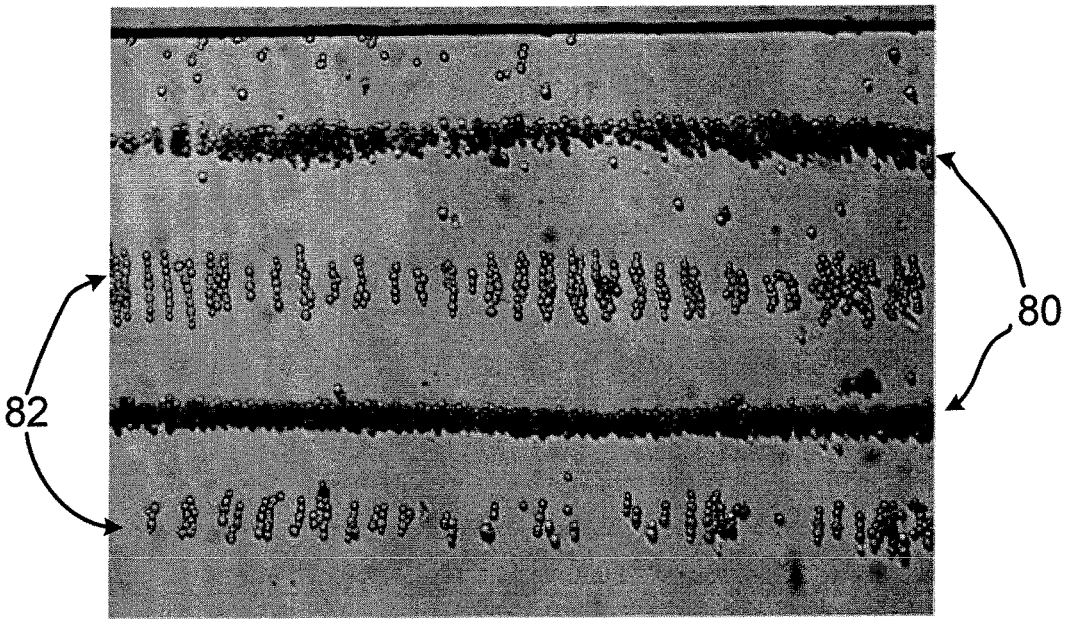
FIGS. 12A and 12B demonstrate further examples of the manipulation of polarizable dielectric particles (live and dead yeast cells) according to an embodiment of this invention.
Figure 12B:
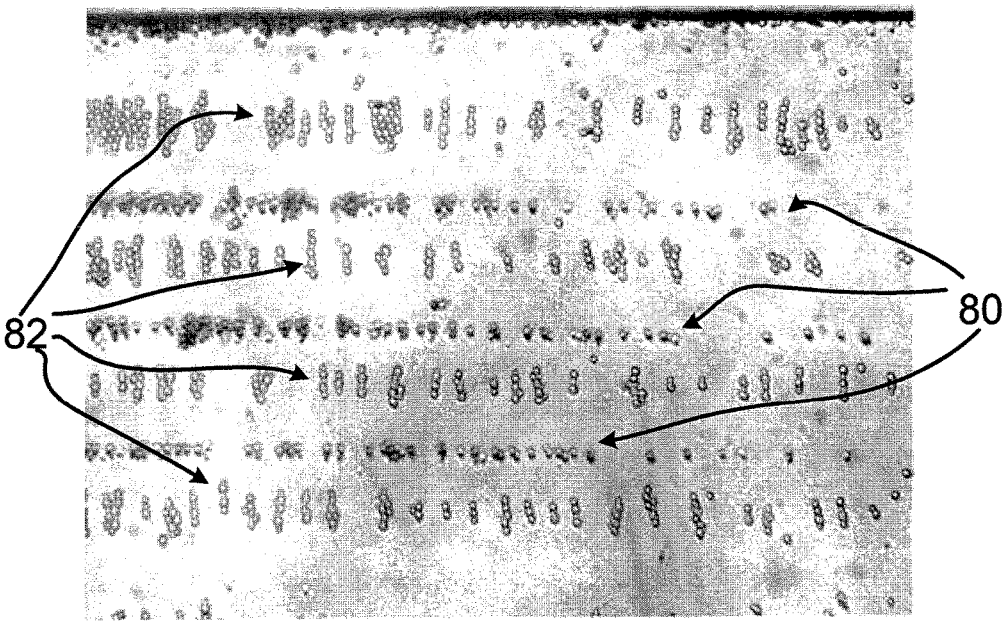

FIGS. 12A and 12B demonstrate separation of living yeast cells from dead yeast cells in accordance with an embodiment of the invention. The yeast species in this embodiment is *Saccharomyces cerevisiae* (a yeast used in baking).

A liquid containing the yeast was injected into the channel 28 of the channel portion 66 described above in relation to FIGS. 10 and 11. The liquid comprised a buffer solution. In this example, the buffer solution was prepared by dissolving a phosphate buffered saline tablet in 100 ml of deionised water. The phosphate buffer in this example had 10 mM $PO_4^{3-}$, 137 mM NaCl, 2.7 mM KCl. This stock solution was then diluted with deionised water (1 part stock solution to 9 parts deionised water). The conductivity of the resulting liquid was measured to be 0.16 S/m.

In accordance with an embodiment of the invention, it has been found that the conductivity of the liquid is important in determining whether positive or negative DEP is exhibited by particles contained therein. An increase or decrease in the conductivity of the liquid corresponds to an increase or decrease in the polarisability of the liquid, respectfully. When a particle in the liquid is more polarisable than the liquid, it exhibits positive DEP, whereas when the particle is less polarisable than the liquid, it will exhibit negative DEP. Accordingly, for increasing liquid conductivity, particles in the liquid tend to switch from exhibiting positive dielectrophoresis to exhibiting negative dielectrophoresis. Because particles such as different kinds of biological cells differ in their polarisability, it is possible to tune the conductivity of the liquid such that one cell type in the liquid is more polarisable than the liquid (positive DEP) while the other is less polarisable than the liquid (negative DEP). For example, at 0.16 S/m liquid conductivity, live yeast cell are more polarisable while dead yeast cells are less polarisable than the liquid. Accordingly, different kinds of cells can be sorted from each other by appropriate selection of the conductivity of the liquid that is used.

In the example of FIG. 12A, a frequency of 9.95 MHz was used, and a power of 24 dBm (0.25 W). In the example of FIG. 12B, a frequency of 20.2 MHz was used, and a power of 22 dBm (0.16 W). Separation of dead yeast cells 80 from living yeast cells 82 is clearly demonstrated in both examples. The transducers 6 in these examples are located on the surface of substrate 2 outside the liquid receiving area with the electrodes running parallel to the rows of cells above and below the horizontal rows of cells 80 and 82 as viewed in FIGS. 12A and 12B. The rows of dead cells 80 experience negative DEP and are aligned with antinodes in the time varying evanescent field induced by the transducers. On the other hand, rows of live cells 82 experience positive DEP and are aligned with nodes in the time varying evanescent field induced by the transducers 6.

FIGS. 13A to 13D further demonstrate dielectrophoresis in dead and living yeast cells. Again the yeast species in this example is *Saccharomyces cerevisiae*. In these examples, the channel 28 of the apparatus 10 included multiple branches as described above in relation to FIG. 11C. The dead and living cells were separated out by dielectrophoresis using transducers located upstream from the branches and the cells were then channeled into respective branches using a method corresponding to that described above in relation to FIG. 4. The direction of liquid flow in FIGS. 13A to 13D is from left to right.

In the Examples of FIGS. 13A to 13D, the yeast cells were included in a liquid solution prepared by adding the following to water: 0.5975% HEPES (25 mM); 0.02% EDTA (0.68 mM); 0.5% BSA (73 μM), 0.1% (0.0175 M) NaCl. In the examples of FIGS. 13A to 13D, a frequency of 9.9 MHz was used, and a power of 24 dBm (0.25 Watts).

Figure 13A:
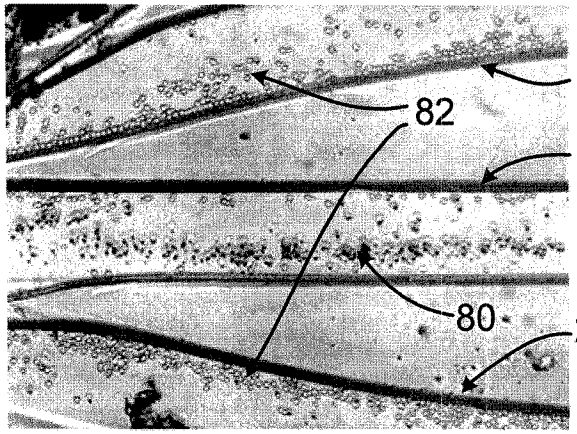
FIGS. 13A to 13D demonstrate further examples of the manipulation of polarizable dielectric particles (live and dead yeast cells) according to an embodiment of this invention.
Figure 13B:
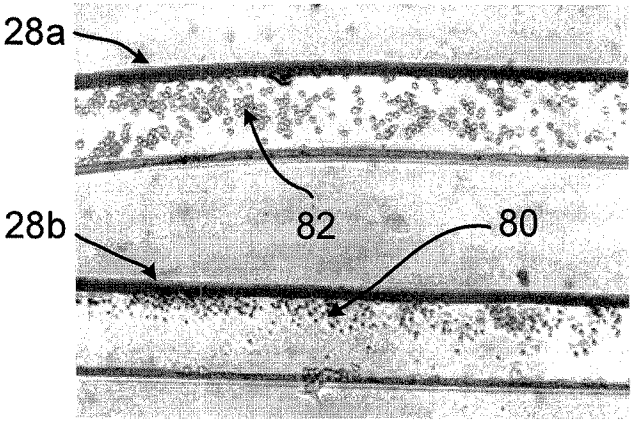
Figure 13C:
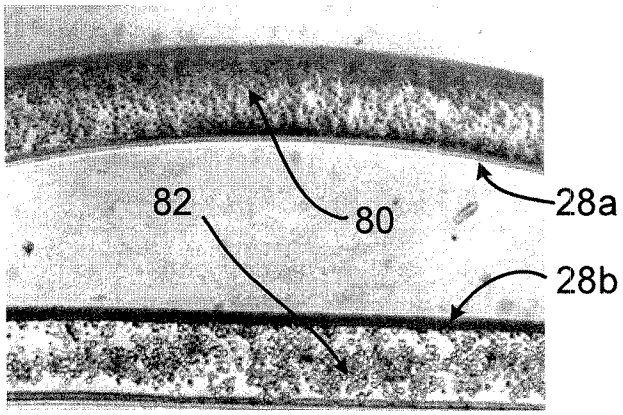
Figure 13D:
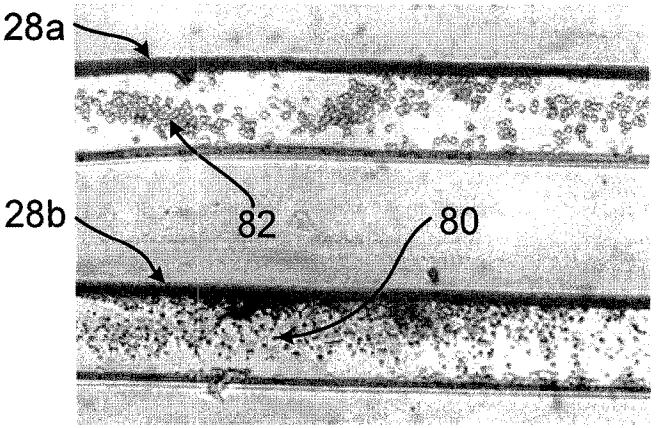

With reference to FIGS. 13A to 13D it can be seen that living and dead yeast cells have been successfully separated in each case. For instance, the upper branch 28*a* and lower branch 28*c* of the three branches shown in FIG. 13A include mostly live yeast cells 82, while the middle branch 28*b* mostly includes dead yeast cells 80. In FIGS. 13B and 13D, the upper branch 28*a* includes mostly live yeast cells 82, while the lower branch 28*b* includes mostly dead yeast cells 80. In FIG. 13C, the upper branch 28*a* includes mostly dead yeast cells 80, while the lower branch 28*b* includes mostly live yeast cells 82.

FIGS. 14A to 14D are graphs that plot and compare the Clausius-Mossotti factors of a number of different kinds of particle as a function of medium conductivity in accordance with an embodiment of the invention. Table 2 indicates the particle type for each plot in FIGS. 14A-14D.

TABLE 2

Predicted Clausius-Mossotti factor plots shown in FIGS. 14A to 14D.

| FIG. | Reference Numeral | Particle Type | References |
|---|---|---|---|
| 14A | 120 | Viable yeast | Patel et al. (2012), except $\sigma_{cyt}$ (arbitrary to fit experimental data) |
| 14A | 121 | Non-viable yeast | Patel et al. (2012), except $\sigma_{cyt}$ (arbitrary to fit experimental data) |
| 14B | 122 | Cervical cancer HeLa | Jen et al. (2012) |
| 14B | 123 | Leukemia-derived cell line, HL-60 | Zheng et al. (2013) |
| 14B | 124 | T-lymphocyte | Becker et al. (1995) |
| 14B | 125 | BRCA MDA231 | Becker et al. (1995) |
| 14B | 126 | Leukemia AML-2 | Zheng et al. (2013) |
| 14B | 127 | Erythrocyte | Becker et al. (1995) |
| 14B | 128 | Breast cancer, MCF-7 | Coley et al. (2006) |
| 14B | 129 | Breast cancer, MCFTaxR | Coley et al. (2006) |
| 14C | 134 | Mouse fibroblast, L929 | Fuhr et al. (1994) |
| 14C | 135 | Healthy breast, HME cell | Sree et al. (2011) |
| 14C | 136 | Breast cancer, MCF-7 | Coley et al. (2006) |
| 14C | 137 | Breast cancer, MCFTaxR | Coley et al. (2006) |
| 14D | 138 | Healthy breast, HME cell | Sree et al. (2011) |
| 14D | 139 | Mouse fibroblast, L929 | Fuhr et al. (1994) |
| 14D | 140 | Bone cancer, SOAS-2 | Ismael et al. (2012) |
| 14D | 141 | Bone cancer MG-63 | Ismael et al. (2012) |

Each graph in FIGS. 14A-14D was prepared for a frequency of 10 MHz, using the formula $$K_{CM}(\omega) = \frac{\epsilon_p^* + \epsilon_m^*}{\epsilon_p^* + 2\epsilon_m^*}$$

where $K_{CM}(\omega)$ is the Clausius-Mossotti factor, $\epsilon^*_p$ is the complex permittivity of particles and $\epsilon^*_m$ is the complex conductivity of the medium. This modelling was based on that described in Becker et al. (1995). Values for the necessary parameters, such as for $\sigma_{cyt}$ (the conductivity of the cell cytoplasm) were collected from the references indicated in the far right column of Table 2. Full details of the references indicated in Table 2 are as follows:

Patel et al (2012) Microfluidic separation of live and dead yeast cells using reservoir-based dielectrophoresis. Biomicrofluidics, 6, 034102.

Becker F F, Wang X B, Huang Y, Pethig R, Vykoukal J, Gascoyne P R. Separation of human breast cancer cells from blood by differential dielectric affinity. Proc Natl Acad Sci USA. 1995 Jan. 31; 92(3):860-864.

Jen, Chun-Ping; Chang, Ho-Hsien; Huang, Ching-Te; et al. MICROSYSTEM TECHNOLOGIES-MICRO-AND NANOSYSTEMS-INFORMATION STORAGE AND PROCESSING SYSTEMS Volume: 18 Issue: 11 Special Issue: SI Pages: 1887-1896.

Zheng et al. (2013) Microfluidic characterization of specific membrane capacitance and cytoplasm conductivity of single cells. Biosensors and bioelectronics, 42, 496-502.

Sree et al. (2011) Electric Field Analysis of Breast Tumor Cells. International Journal of Breast Cancer, 235926.

Fuhr et al. (1994) Cell manipulation and cultivation under a.c. electric field influence in highly conductive culture media. Biochimica et Biophysica Acta. 1201 353-360.

Coley et al. (2006) Biophysical characterization of MDR breast cancer cell lines reveals the cytoplasm is critical in determining drug sensitivity. Biochimica et Biophysica Acta. 1770, 601-608.

Ismael et al. (2012) Characterization of human skeletal stem and bone cell populations using dielectrophoresis. Journal of tissue engineering and regenerative medicine. doi: 10.1002/term.1629.

The graphs in FIGS. 14A-14D can be used to predict the Clausius-Mossotti factor of various particles comprising biological materials (e.g. cells) so that the appropriate medium conductivity can be selected for manipulation (e.g. sorting) at a given frequency.

Figure 14A:
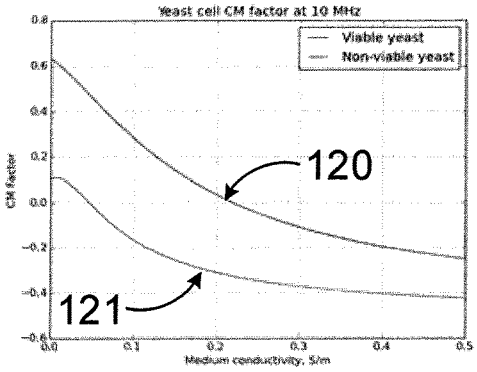
FIGS. 14A to 14D are graphs predicting the Clausius-Mossotti factor as a function of the conductivity of the liquid in which the particles are provided in accordance with an embodiment of the invention.
Figure 14B:
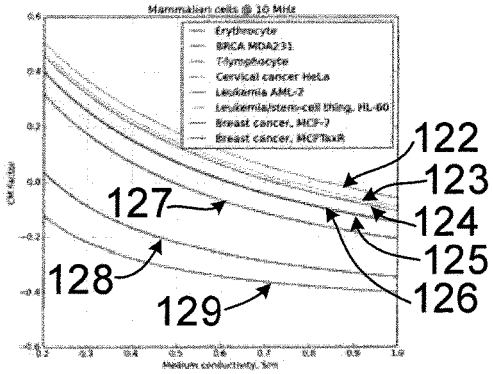
Figure 14C:
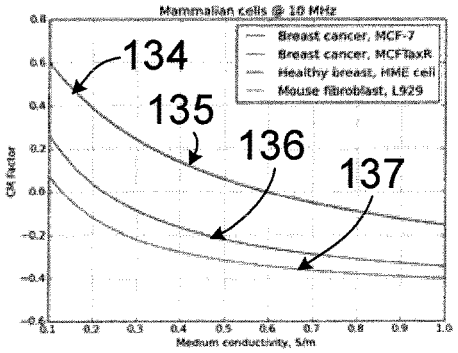

For example, with reference to FIG. 14C it can be seen that the graph predicts that at an applied frequency of 10 MHz and with a medium conductivity of around 0.4 S/m, healthy breast cells (line labelled 135) will exhibit positive dielectrophoresis while cancerous ones (lines 136 and 137) will exhibit negative dielectrophoresis. This suggests that healthy breast cells may be separated from cancerous ones in a liquid having a conductivity of around 0.4 S/m, at an applied frequency of 10 MHz, using dielectrophoresis.

Figure 15:
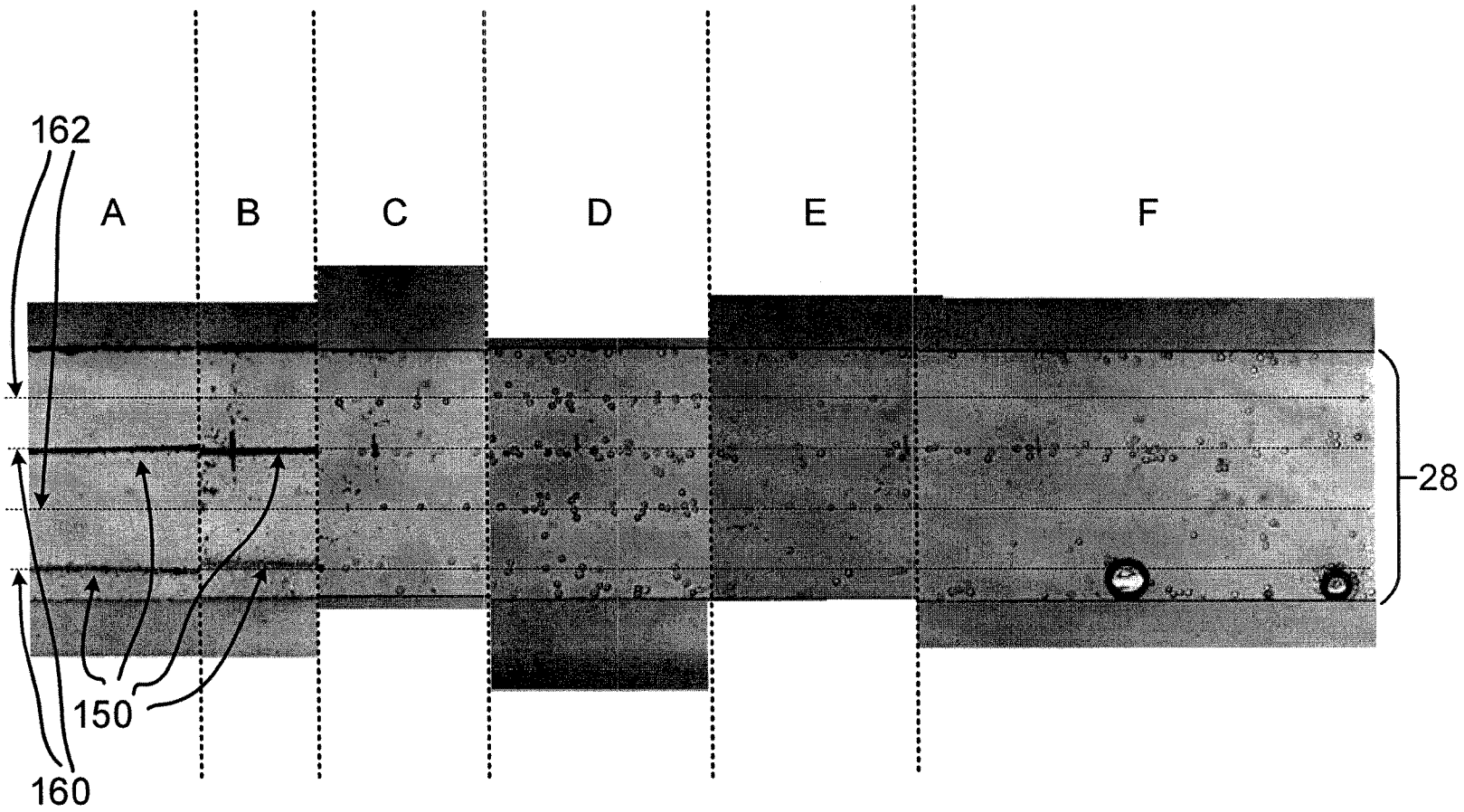
FIG. 15 demonstrates a further example of the manipulation of polarizable dielectric particles (mouse fibroblast, L929 cells) according to an embodiment of this invention.

FIG. 15 demonstrates dielectrophoresis in mouse fibroblast, L929 cells in accordance with an embodiment of the invention. These cells are shown within a channel 28 of the kind described above in relation to, for example FIGS. 10 and 11. A frequency of 9.90 MHz was used, and a power of 24 dBm (0.25 Watts). The transducers in this example are located on the surface of substrate 2 outside the liquid receiving area with the electrodes running parallel to the rows of cells above and below the channel as viewed in FIG. 15.

FIG. 15 is a composite of several separate results in the sense that each section A-F displays the arrangement particles in the channel for a different medium conductivity. These sections are shown side-by-side in FIG. 15 for the purposes of comparison. Table 3 below summarises the conductivity of the liquid (experimentally measured by a conductivity meter) and details of the particles and liquid itself (buffer solution) in each section A-F.

TABLE 3

Summary of Sections A-F Shown in FIG. 15.

| Section | Description | NaCl Content of Buffer Solution |
|---|---|---|
| A | Control using deionised water with conductivity 0.001 S/m and latex beads | No NaCl |

TABLE 3-continued

Summary of Sections A-F Shown in FIG. 15.

| Section | Description | NaCl Content of Buffer Solution |
|---|---|---|
| | (1 μm diameter) | |
| B | Control using high osmolarity solution with conductivity 0.01 S/m and latex beads (1 μm diameter) | No NaCl |
| C | L929 cells, high osmolarity solution with conductivity = 0.14 S/m | ~0.015M NaCl |
| D | L929 cells, high osmolarity solution with conductivity = 0.29 S/m | ~0.035M NaCl |
| E | L929 cells, high osmolarity solution with conductivity = 0.52 S/m | ~0.06M NaCl |
| F | L929 cells, high osmolarity solution with conductivity = 0.79 S/m | ~0.10M NaCl |

In section A of FIG. 15, negative dielectrophoresis in fluorescent latex beads 150 having a diameter of 1 μm is demonstrated as a control sample. The beads were provided in a liquid comprising deionised water.

In section B of FIG. 15, negative dielectrophoresis in fluorescent latex beads 150 having a diameter of 1 μm was again demonstrated as a control sample. In this case, the beads were provided in a liquid comprising a high osmolarity solution. The same liquid (albeit with different conductivities owing to their different NaCl contents as shown in Table 3) was used as a buffer solution in the examples explained below involving L929 cells in sections C-F.

In FIG. 15, the dotted lines 160 are used to denote the positions in the channel 28 at which negative dielectrophoresis is expected to occur at the applied frequency. Note that the latex beads 150 in sections A and B are aligned with the lines 160. Similarly, the lines 162 in FIG. 15 are used to denote the positions in the channel 28 at which positive dielectrophoresis is expected to occur at the applied frequency.

A high osmolarity solution was used as a buffer for the L929 cells. Note that unlike yeast cells, which are more robust to changes in osmotic pressure, for mammalian cells the solution osmolarity should be made similar to that of physiological conditions (e.g. in the blood). In accordance with the present embodiment, this was achieved by adding sucrose and dextrose to increase the osmotic pressure.

The high osmolarity solution contained: 25 mM 4-(2-hydroxyethyl)-1-piperazineethanesulfonic acid (HEPES) buffer, 0.02% (0.68 mM) Ethylenediaminetetraacetic acid (EDTA—Sequesters Ca2+, prevents cells forming junctions/sticking together), 0.5% (73 μM) Bovine serum albumin (BSA—blocks surfaces, prevents non-specific binding of cells), 7.5% (0.219 M) sucrose and 0.3% (0.016 M) dextrose. This was used as a stock high osmolarity solution, to which varying amounts of NaCl was also added for varying the conductivity of the liquid (see Table 3)—the molarity of NaCl is estimated to be accurate to around ±15%.

Figure 14D:
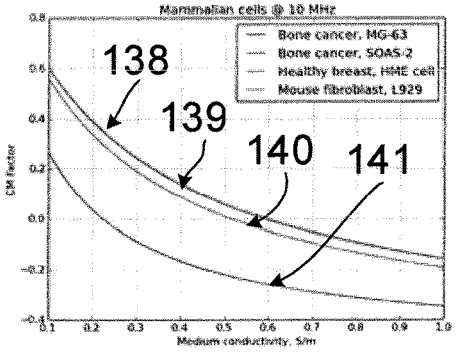

At the applied frequency of 9.90 MHz, the predicted cross-over of the Clausius-Mossotti factor as a function of the conductivity of the liquid for live L929 cells is predicted to be around 0.58 S/m (see, for example, FIG. 14D). Accordingly, it is expected that negative dielectrophoresis should be seen at conductivities of greater than 0.58 S/m, and positive dielectrophoresis should be seen at conductivities of less than 0.58 S/m.

Returning to FIG. 15, in sections C-F, at least some cells in the liquid appear to be exhibiting negative dielectrophoresis (see the cells located in the region of the lines 160) at each different conductivity, even at conductivities below 0.58 S/m. A control viability test showed that roughly 30% of the L929 cells in the liquid were non-viable (dead). It is thought that this explains the observation of cells showing negative dielectrophoresis even below 0.58 S/m—the cells showing negative dielectrophoresis at lower conductivities are thought to be of non-viable type.

Cells exhibiting positive dielectrophoresis are also visible in sections C and D and perhaps also section E. This fits well with the expected positive dielectrophoresis in live L929 cells at these lower conductivities, below the predicted cross-over value of 0.58 S/m noted above.

There do not appear to be any cells experiencing positive dielectrophoresis in section F (0.79 S/m). It is thought that both live and dead L929 cells may be experiencing negative dielectrophoresis in a liquid at this conductivity (see the cells close to the upper dotted line 160).

Accordingly, use of a method according to an embodiment of this invention, which involves manipulating cells such as yeast cells and mammalian cells such as L929 cells has been demonstrated.

Accordingly, there has been described a method and apparatus for manipulating polarizable dielectric particles. The method includes positioning a liquid containing the particles above a surface of a piezoelectric material. The method also includes inducing a shear-horizontal surface acoustic wave in the piezoelectric material, thereby to form a time-varying non-uniform evanescent electric field extending into the liquid. The method further includes using the time-varying non-uniform evanescent electric field to apply a force to at least some of the particles by dielectrophoresis.

Although particular embodiments of the invention have been described, it will be appreciated that many modifications/additions and/or substitutions may be made within the scope of the claimed invention.

The invention claimed is:

1. A method of manipulating polarizable dielectric particles, the method comprising:

positioning a liquid containing polarizable dielectric particles above a surface of a piezoelectric material, wherein a conductivity of the liquid is in the range of 0.001 to 2.0 S/m;

inducing a shear-horizontal surface acoustic wave in the piezoelectric material, thereby to form a time-varying non-uniform evanescent electric field extending into the liquid; and using the time-varying non-uniform evanescent electric field to apply a force to at least some of the polarizable dielectric particles to manipulate the polarizable dielectric particles by dielectrophoresis.

2. The method of claim 1, wherein the shear-horizontal surface acoustic wave is a composite wave comprising two components travelling in opposite directions in the piezoelectric material.

3. The method of claim 2, wherein the shear-horizontal surface acoustic wave is a standing wave.

4. The method of claim 3, wherein the liquid contains a plurality of types of polarizable dielectric particles, each type of polarizable dielectric particle having respective polarization properties, the method comprising sorting a plurality of polarizable dielectric particles of a first type from a plurality of polarizable dielectric particles of a second type by allowing the polarizable dielectric particles contained in the liquid to move toward regions of higher or lower electric field gradient according to whether they experience positive dielectrophoresis or negative dielectrophoresis.

5. The method of claim 4, further comprising separating the plurality of polarizable dielectric particles of the first type from the plurality of polarizable dielectric particles of the second type by directing them along respective fluid channels after they have been sorted by dielectrophoresis in a region above the surface of the piezoelectric material.

6. The method of claim 2, further comprising applying a force to the polarizable dielectric particles in the liquid by varying a frequency and/or phase of at least one of the two components of the composite shear-horizontal surface acoustic wave to reposition one or more nodes or antinodes of the time-varying evanescent electric field above the surface of the piezoelectric material.

7. The method of claim 1, further comprising:

causing the liquid containing the polarizable dielectric particles to flow in a first direction above the surface of the piezoelectric material; and sorting the polarizable dielectric particles contained in the liquid by applying a dielectrophoretic force to the polarizable dielectric particles in a second direction different from the first direction.

8. The method of claim 7, comprising sorting the polarizable dielectric particles in the liquid according to an amount by which they are deflected as the liquid containing them traverses a region of the piezoelectric material.

9. The method of claim 1, wherein the polarizable dielectric particles in the liquid comprise biological cells.

10. The method of claim 1, further comprising selecting a particular conductivity of the liquid according to the Clausius-Mossotti factor of polarizable dielectric particles to be manipulated, for applying a force to at least some of the polarizable dielectric particles in the liquid either by positive or negative dielectrophoresis in the time-varying non-uniform evanescent electric field.

11. A particle manipulation apparatus for manipulating polarizable dielectric particles contained in a liquid, the apparatus comprising:

a substrate comprising a piezoelectric material that supports generation of shear-horizontal surface acoustic waves;

a liquid-receiving region located above a surface of the substrate;

a liquid contained in the liquid-receiving region, wherein the liquid contains polarizable dielectric particles and has a conductivity in the range of 0.001 to 2.0 S/m; and a first transducer configured to induce a shear-horizontal surface acoustic wave in the piezoelectric material beneath the liquid-receiving region, thereby to form a time-varying non-uniform evanescent electric field extending into the liquid-receiving region for applying a force to at least some of the polarizable dielectric particles by dielectrophoresis.

12. The particle manipulation apparatus of claim 11, wherein the liquid-receiving region comprises a channel through which the liquid containing the polarizable dielectric particles can flow.

13. The particle manipulation apparatus of claim 11, wherein the liquid-receiving region is furcated at one end to define a plurality of branches, each branch for receiving polarizable dielectric particles manipulated by dielectrophoresis within the liquid-receiving region.

14. The particle manipulation apparatus of claim 11, further comprising a second transducer configured to cooperate with the first transducer to induce a composite shear-horizontal surface acoustic wave comprising two components travelling in opposite directions in the piezoelectric material.

15. The particle manipulation apparatus of claim 14, wherein the composite wave is a standing wave.

16. The particle manipulation apparatus of claim 14 further comprising circuitry for varying a frequency and/or phase of a signal applied to one or each of the first and second transducers to vary a frequency and/or phase of at least one of the two components of the composite shear-horizontal surface acoustic wave to reposition one or more nodes or antinodes of the time-varying evanescent electric field above the surface of the piezoelectric material.

17. The particle manipulation apparatus of claim 11 further comprising one or more reflectors positioned behind the first transducer to reflect a part of the surface acoustic wave induced by the first transducer back toward the liquid-receiving region.

18. The particle manipulation apparatus of claim 11 further comprising a waveguide layer located between the piezoelectric material of the substrate and the liquid-receiving region.

19. The particle manipulation apparatus of claim 11 further comprising one or more sensors positioned to sense a property of the polarizable dielectric particles in the liquid in the liquid-receiving region.

20. The particle manipulation apparatus of claim 11, wherein the piezoelectric material comprises lithium tantalate, quartz, langasite, or lithium niobate.

* * * * *